US006457885B1

(12) United States Patent
Yamamoto et al.

(10) Patent No.: US 6,457,885 B1
(45) **Date of Patent: *Oct. 1, 2002**

(54) THERMAL TRANSFER RECORDING APPARATUS, INK FILM CASSETTE AND INK FILM REEL

(75) Inventors: Junichi Yamamoto; Atsuhiko Shimoyama, both of Toyohashi (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/961,375

(22) Filed: Oct. 30, 1997

(30) Foreign Application Priority Data

| | | |
|---|---|---|
| Oct. 31, 1996 | (JP) | 8-290735 |
| Oct. 31, 1996 | (JP) | 8-290736 |
| Oct. 31, 1996 | (JP) | 8-290737 |
| Oct. 31, 1996 | (JP) | 8-290738 |

(51) Int. Cl.[7] ..... B41J 35/28
(52) U.S. Cl. ..... 400/207; 400/224.2
(58) Field of Search ..... 400/224.2, 207

(56) References Cited

U.S. PATENT DOCUMENTS

| | | | | |
|---|---|---|---|---|
| 4,702,631 A | * | 10/1987 | Watanabe | 400/224.2 |
| 4,907,902 A | * | 3/1990 | Doi | 400/249 |
| 4,978,240 A | * | 12/1990 | Katsuno | 400/224.2 |
| 5,073,052 A | * | 12/1991 | Daley et al. | 400/208 |
| 5,246,299 A | * | 9/1993 | Kitsuki et al. | 400/234 |
| 5,447,382 A | * | 9/1995 | Yui et al. | 400/224.2 |
| 5,544,965 A | * | 8/1996 | Kamoda et al. | 400/582 |
| 5,562,352 A | * | 10/1996 | Whritenor et al. | 400/242 |
| 5,597,248 A | * | 1/1997 | Burgin | 400/207 |
| 5,622,440 A | | 4/1997 | Yamamoto et al. | 400/234 |

FOREIGN PATENT DOCUMENTS

| | | |
|---|---|---|
| JP | 5-162405 | 6/1993 |
| JP | 07089171 | * 4/1995 |
| JP | 7-329385 | 12/1995 |

* cited by examiner

*Primary Examiner*—John S. Hilten
*Assistant Examiner*—Charles H. Nolan, Jr.
(74) *Attorney, Agent, or Firm*—Sidley Austin Brown & Wood

(57) ABSTRACT

A thermal transfer recording apparatus, which has a detachable ink film cassette with an ink film, transfers an ink applied to the ink film to a recording paper by means of a thermal head and forms an image on the recording paper. The ink film cassette holds a supply reel wound around the shaft with the ink film and a take-up reel for taking up the ink film of the supply reel around the shaft. The thermal transfer recording apparatus has a detecting unit for detecting the supply reel mounted in the cassette, and a control unit for detecting the ink film based on a signal from the detecting unit. The detecting unit has a lever, which advances through an opening formed in the cassette from the direction perpendicular to the direction of the axis of the supply reel and comes in contact with the supply reel, and a photosensor for detecting the supply reel through of the lever. This thermal transfer recording apparatus can detect missing of the ink film in advance of the start of a printing operation.

19 Claims, 33 Drawing Sheets

THERMAL TRANSFER RECORDING APPARATUS, INK FILM CASSETTE AND INK FILM REEL

BACKGROUND OF THE INVENTION

1. Field of the Invention

This invention relates to a thermal transfer recording apparatus, which is used in a manner having detachably mounted a so-called refill type ink film cassette wherein the ink film is replaced or refilled with a new supply, and the refill type ink film cassette, and an ink film reel, which is used in the refill type ink film cassette.

2. Description of the Related Art

The thermal transfer recording apparatus is provided with a platen roller and a thermal head, which is freely pressed against and separated from the platen roller. A recording paper is conveyed through the contacting surface between the platen roller and the thermal head. An ink film, which has an ink with thermally fusible or sublimating properties applied to one surface, is conveyed into the contacting surface between the recording paper and the thermal head. This ink film is drawn out from a reel on the supply side and wound on a reel on the take-up side. When a color image is reproduced by one thermal head on the recording paper, the thermal transfer recording apparatus uses the ink film which has the inks in the colors of yellow, magenta, and cyan applied sequentially in the order on the surface of a thin film base.

The ink film is drawn out from the supply reel and conveyed in conjunction with the motion of the recording paper by friction force between the ink film and the recording paper, which is conveyed between the platen roller and the thermal head in a state of being pressed against the platen roller, during the printing process. The ink film paid out of the supply reel is wound on the take-up reel by rotating the take-up reel with a motor installed in the main body of the thermal transfer recording apparatus.

In recent years, an ink film cassette, which holds a supply reel and a take-up reel and is freely attached to and detached from the main body, is applied to the thermal transfer recording apparatus for improving the efficiency of the setting work of the ink film.

The ink film cassette of a disposable type has been proposed, for example, in consideration of the convenience of use. In this case, the cassette is a consumable good and thus wholly replaced with a newly supplied cassette when the built-in ink film is used up.

From the viewpoint of the global ecology, there has been found growing recognition that an ink film cassette of the so-called refill type with ink film which is replaced or refilled, is desirably used in the place of the disposable cassette.

The refill type cassettes of this class are known in the following various types. In one type of the refill type cassette, a user identifies a type of an ink film and sets the ink film in a cassette corresponding to the type of the ink film. In the thermal transfer recording apparatus that uses this type of ink film cassette, the attachment of the cassette is checked and a type of the ink film is identified by detecting the attached cassette.

The conventional refill type ink film cassette indeed is at an advantage in affording due consideration for the environment. It has the problem, however, that the apparatus is incapable of discerning between the presence and the absence of the film until it starts a printing operation even though a user, while replacing a spent ink film with a new supply, happens to forget to place an ink film in the cassette and set this cassette in the apparatus.

Further, this ink film cassette compels a user to incur the trouble of ensuring coincidence between a type of the ink film and a type of the cassette in case of the replacement of the ink film. It has still another problem that the ink film cassette must be manufactured or owned exclusively for the ink film of the particular type. If the user fails to secure the coincidence between the ink film and the cassette, the thermal transfer recording apparatus cannot detect the failure and the ink film or the recording paper wastefully consumed.

JP-A-05-162,405 discloses a cassette of the disposable type, which is so designed as to identify the type of the ink film. This cassette has a ring with a mark indicative of the type of ink film, which is rotatably disposed at one end of a reel for winding an ink film. It attains identification of the type of the ink film by causing the ring to rotate. Namely, this cassette can acquire the information on the film by only rotating the ring without requiring rotating the reel. However, it inevitably complicates the mechanism for rotational drive because the cassette must exclusively rotate the ring. If this method is applied to the refill type cassette, it requires that a user mounts the ring to the reel or a reel with a built-in ring is manufactured. The attempt results in complicating the work of replacement and increasing the cost.

The conventional thermal transfer recording apparatus is provided in the main body with a supply side torque limiter, which is connected to the supply reel and gives a braking force to the supply reel after the ink film cassette has been set in place. This supply side torque limiter continues to give a braking force to the supply reel while the ink film is being paid out of the supply reel. As a consequence, the limiter fulfills the purpose of transmitting due tension to the ink film and preventing the ink film from forming wrinkles during the printing process.

Further, a take-up side torque limiter, which limits a driving torque of the take-up reel, is disposed between the take-up reel and the motor in the main body of the thermal transfer recording apparatus. This take-up side torque limiter is provided for the following reason besides the reason of transmitting due tension to the ink film during the printing process. The conveying speed of the recording paper and the ink film must be equalized in the printing unit. However, the winding speed of the ink film on the take-up reel is inevitably varied as the roll diameter of the ink film wound in the take-up reel varies even when the supporting shaft of the take-up reel is rotated at a fixed speed. It is, therefore, provided with the take-up side torque limiter for enabling the winding speed to follow the conveying speed of the ink film in the printing unit and winding the ink film without slacking on the take-up reel.

The provision of the supply side and the take-up side torque limiters inside the thermal transfer recording apparatus complicates the arrangement of the recording apparatus, and boosts the cost, and inhibits all efforts to miniaturize the apparatus. The torque limiters provided inside the apparatus are required to possess durability on a par with other components used inside the apparatus, for example the durability to permit normal formation of images on 60,000 recording papers. Namely, the torque limiters must be relatively expensive. And, the use of these torque limiters inevitably results in adding to the cost of the thermal transfer recording apparatus as a whole. The present inventors have proposed an ink film cassette with a built-in supply side torque limiter and a take-up side torque limiter for the purpose of simplifying the main body of a thermal transfer recording apparatus and lowering the cost (JP-A-07-329, 385). This ink film cassette is so designed that a user can refill an ink film by a simple procedure. And, the number of disposable components is decreased to the fullest possible extent and due respect is paid to the problem of environment.

The ink film cassette with built-in torque limiters enjoys the above advantage. However, the cassette incurs the possibility that a user forgets the torque limiters, or mistakes the supply side torque limiter for the take-up side torque limiter or vice versa and misplaces the torque limiters, in case of the work of refilling an ink film.

SUMMARY OF THE INVENTION

An object of this invention is to provide a thermal transfer recording apparatus, which is capable of simply and easily discerning between the absence and presence of an ink film prior to the start of the printing operation.

A further object of this invention is to provide a thermal transfer recording apparatus, which is capable of simply and easily identifying a type of the ink film and discerning erroneous mounting of the ink film prior to the start of the printing operation.

Another object of this invention is to provide a refill type ink film cassette and an ink film reel used for the cassette.

Still another object of this invention is to provide an ink film cassette, which is applicable to a plurality of types of ink films and is capable of identification of the type of the ink film.

Yet another object of this invention is to provide an ink film cassette, which ensures inexpensive prevention of the misplacement of torque limiters, precludes erroneous attachment of the torque limiters, and avoids enlarging the cassette without sacrificing the facility of both attachment and detachment of reels.

A further object of this invention is to provide an ink film cassette, which ensures inexpensive prevention of the misplacement of torque limiters and precludes not only the torque limiters but also reels from being erroneously attached without sacrificing the facility of both attachment and detachment of reels.

One aspect of the present invention concerns a thermal transfer recording apparatus with a detachably mounted ink film cassette having an ink film for transferring an ink applied to the ink film to a recording paper by a heating element: and forming an image on the recording paper, which comprises the ink film cassette which holds a supply reel that has the ink film wound around a shaft, and a take-up reel that takes up the ink film wound around the shaft of the supply reel on a shaft; detecting units which detect the reels mounted in the ink film cassette; and a control unit which discerns between a presence and an absence of the ink film based on a signal outputted from the detecting units. In this thermal transfer recording apparatus, the detecting units detect the reels and the controller discerns the presence of the ink film when the ink film cassette with the reels is mounted in the apparatus. Accordingly, the presence or the absence of the ink film wound on the reels is detected and the possible missing of the ink film can be simply and easily checked prior to the start of the printing operation. Then, a alarm to the user maybe outputted or a printing action may be done, depending on the outcome discerned by the controller concerning the presence and the absence of an ink film.

A further aspect of this invention concerns a thermal transfer recording apparatus with a detachably mounted ink film cassette having an ink film for transferring an ink applied to the ink film to a recording paper by a heating element: and forming an image on the recording paper, which comprises the ink film cassette holding a supply reel, which has the ink film wound around a shaft, and a take-up reel, which takes up the ink film wound around the shaft of the supply reel on a shaft; targets for detection, which are provided at edges of the reels held in the ink film cassette; detecting units which detect the targets; and a control unit which discerns between a presence and an absence of the ink film based on a signal outputted from the detecting units. In this thermal transfer recording apparatus, the detecting units detect the targets at the edges of the reels and the controller discerns between the presence and the absence of the ink film when the ink film cassette with the reels is mounted in the apparatus. As a result, the possible missing of the ink film can be simply and easily checked prior to the start of the printing operation.

Another aspect of this invention concerns an ink film detachably mounted in a thermal transfer recording apparatus and having an ink film coated with an ink, which comprises a supply reel. which is wound with the ink film; a take-up reel which takes up the ink film paid out of the supply reel; and a mark which is placed at an edge of either of the reels and indicates a type of the held ink film. The mark is preferably disposed in the edge of the supply reel. Concerning this ink film cassette, the mark indicates a type of the ink film. A type of the ink film and the erroneous mounting of the ink film can be simply and easily discerned prior to the printing operation by merely mounting the ink film cassette in the thermal transfer recording apparatus.

Still another aspect of this invention concerns an ink film reel being wound with a ink film for a thermal transfer recording apparatus for transferring an ink applied to the ink film to a recording paper by means of a heating element, and forming an image on the recording paper, which comprises a target for detection which is provided in at least either of opposite edges of the reel, and corresponds to a specific type of the ink film. It is preferable that the ink film reel is detachably mounted in the ink film cassette, and further the ink film reel held in the ink film cassette is detachably mounted in the thermal transfer recording apparatus. According to this arrangement, a type of the ink film can be discerned based on the target that is disposed in the ink film reel and not based on such factors as the shape of the ink film cassette. It does not require manufacturing or owning an ink film cassette used exclusively for one type of ink film. Namely, one type of the cassette can correspond to a plurality of types of ink films and permit perfect identification of such different types of ink films. And, the ink film reel proves to be advantageous for use in the refill type cassette in respect that a user is free from the trouble of deliberately causing the type of the cassette to coincide with the type of the ink film, in case of the replacement of the ink film.

Yet another aspect of this invention concerns an ink film cassette for being detachably mounted to a thermal transfer recording apparatus, which comprises a supply reel which is wound with an ink film; a take-up reel which takes up the ink film paid out of the supply reel; a braking unit which gives a braking force to the supply reel in the cassette; a first frame which holds the supply reel and the take-up reel; and a second frame which holds the braking unit and is detachably mounted in the first frame. In the arrangement of the ink film cassette, the replacement of a spent ink film is composed of removing the supply reel and the take-up reel from the first frame while keeping the braking unit supported on the second frame, and then setting a newly supplied reel in place. It essentially eliminates the possibility that the braking unit is missed or the braking unit is mistaken and is erroneously mounted on the take-up side during the replacement of the ink film. And, it is made possible to reuse and recover the braking unit, decrease the number of waste components to the fullest possible extent and contribute to the conservation of the environment. Incidentally, the first frame holds the supply reel and the second frame holds the braking unit separately. The attachment and detachment of the supply reel with respect to the first frame are attained without paying any respect to the braking unit and thus are accomplished with ease. Moreover, it does not require the space, which is used for the work of connecting the supply reel with the brake unit, and prevents the possible increase of the size of the cassette.

Another aspect of this invention concerns an ink film cassette with a built-in torque limiter for being detachably mounted in a thermal transfer recording apparatus, which comprises a first frame which holds a reel connected to the torque limiter; and a second frame which holds the torque limiter and is freely attached to and detached from the first frame; the reel and the torque limiter having ratchet shaped connected surfaces respectively. The arrangement of the ink film cassette essentially eliminates the possibility that the torque limiter is missed or the torque limiter is mistaken and erroneously mounted during the replacement of the ink film. And, it is made possible to reuse and recover the torque limiter. Incidentally, the first frame holds the reel and the second frame holds the torque limiter individually. The attachment and detachment of the reel with respect to the first frame can be attained without requiring attention to the torque limiter and can be fulfilled with ease. Moreover, it can save the space, which would be otherwise required for the work of connecting the reel with the torque limiter, and prevent the possible increase of the size of the cassette. In addition, the connected surfaces of the reel and the torque limiter are each formed in the shape of a ratchet. The inclined faces (resembling saw teeth) of the ratchets cause the reel and the torque limiter to be relatively rotated and be perfectly engaged with each other and brought into perfect union even in the absence of correct union of the two connected surfaces during the interconnection between the reel and the torque limiter. In brief, the reel does not need to be accurately positioned in mounting the reel. The replacement of the ink film is done with ease and the connection of the reel and the torque limiter is facilitated.

Another aspect of this invention concerns an ink film reel for use in an ink film cassette with a built-in torque limiter, which comprises a ratchet shaped surface that is provided in an edge and connected to the torque limiter. The ink film reel having the ratchet, shaped edge does not need to be positioned accurately in mounting. Accordingly, the reel is easily mounted to the ink film cassette with a built-in torque limiter and connected with the torque limiter as well.

BRIEF DESCRIPTION OF THE DRAWINGS

FIG. 4A depicting the operation in the course of paper feeding, FIG. 4B depicting the start of the printing operation, and FIG. 4C depicting the completion of the printing operation;

FIG. 27A depicting the fifth embodiment and FIG. 27B depicting a comparative case;

DETAILED DESCRIPTION OF THE PREFERRED EMBODIMENTS

Now, a thermal transfer recording apparatus according to an embodiment of this invention will be described below with reference to the above drawings.

First Embodiment

<<Arrangement of Thermal Transfer Recording Apparatus>>

Figure 1:
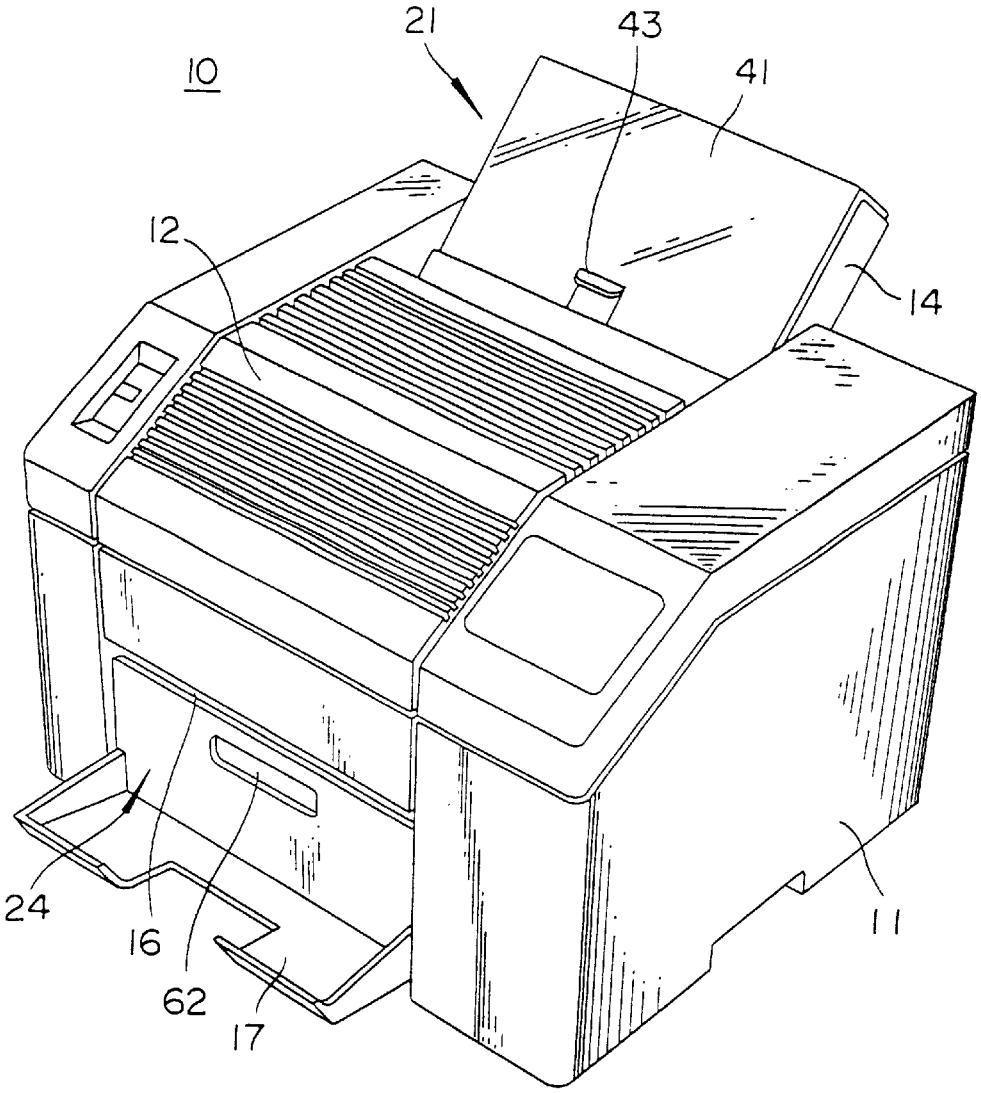
FIG. 1 is a perspective view illustrating the appearance of a thermal transfer recording apparatus in which an ink film cassette according to an embodiment of this invention is detachably set.

FIG. 1 is a perspective view illustrating the appearance of a thermal transfer recording apparatus in which an ink film cassette is detachably loaded. For the sake of convenience of the description, the edge of a recording paper, which forms the side of the leading end at being discharged from the thermal transfer recording apparatus, will be referred to as the "leading end of the recording paper".

A thermal transfer recording apparatus 10 illustrated in the diagram is used at, for example, a processing station for printing photographs for producing a so-called index print, i.e. the reproduction on one recording paper of such information as is originally recorded in a plurality of frames on a negative film. A control device (not shown), which performs various image processing operations on the information recorded on the negative film, is connected to the apparatus 10 through an interface. The control device inputs the image signals and the control signals into the apparatus 10 through the interface.

Figure 2:
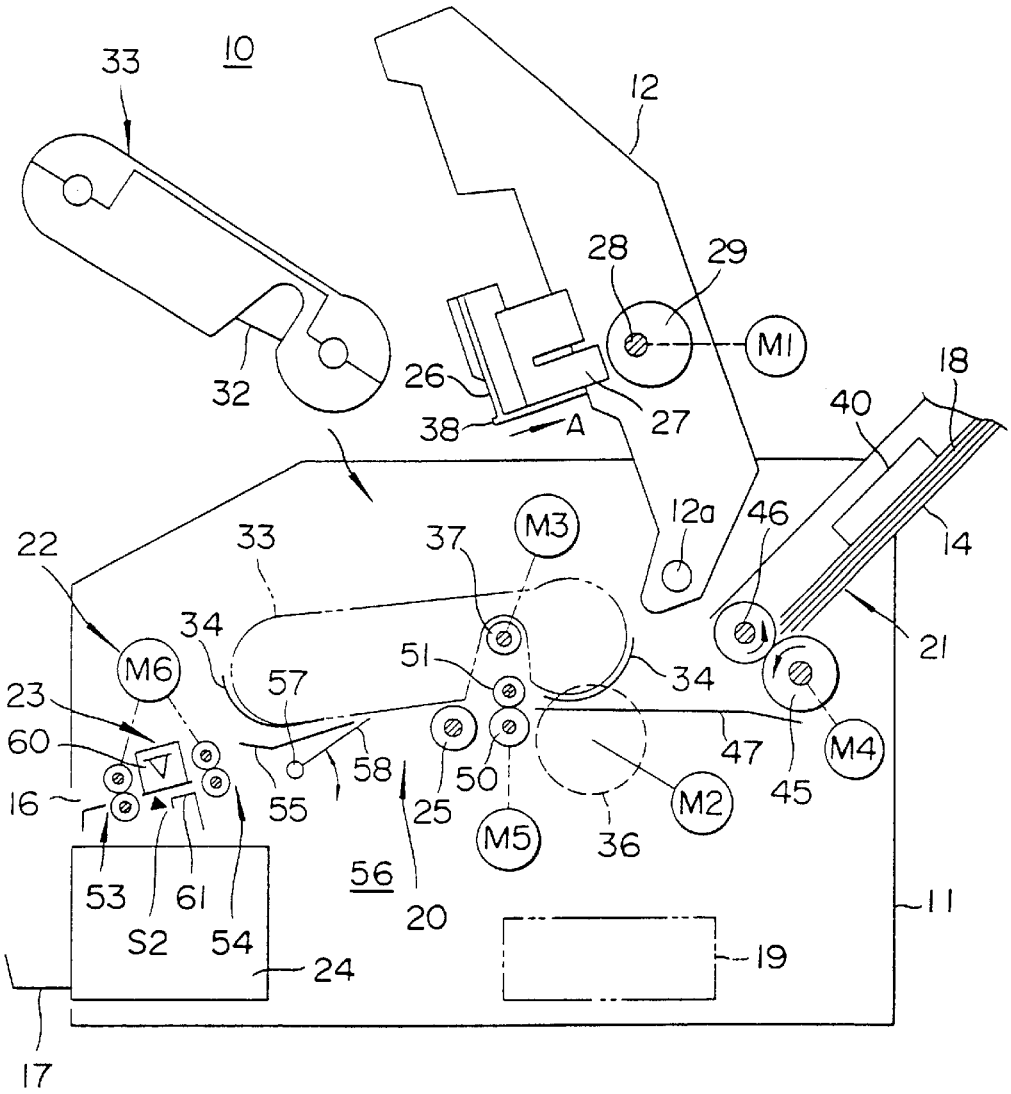
FIG. 2 is a schematic cross section illustrating the inner arrangement of the apparatus with a lid posed in an opened state.

A lid 12 is mounted to the upper surface of a housing 11 which constitutes the main body of the apparatus 10 so as to be opened and closed freely around a rocking shaft 12*a* (FIG. 2). With the lid 12 in an opened state, an ink film cassette is set at a desired position in the housing 11. The left foreground side in the diagram forms the front surface of the apparatus 10. A paper-discharging unit is provided on the front surface side. A feeder section 21 is provided on the rear surface side. In the feeder section 21, a paper tray 14 holding a plurality of recording papers is disposed aslant. The apparatus 10 is further provided with a cutter unit which, as will be specifically described herein below, cuts off such unnecessary parts of a recording paper, namely the leading end and/or the trailing end of a recording paper after the reproduction of an image. A dust holder 24 for storing the cut-off of paper or scraps is set in place detachable on the front surface side of the thermal transfer recording apparatus. After the removal of the unnecessary parts, the recording paper is passed through an outlet 16 and outputted in the longitudinal direction onto a output tray 17 which is integrally formed on the front side of the dust holder 24. The recording paper is outputted in the longitudinal direction. Thus, the size of the output tray 17, which protrudes from the front surface of the housing 11, is relatively small. The paper tray 14 is disposed aslant. As a result, the thermal transfer recording apparatus requires only small space for the entire installation and fits installation at a place, which offers only a cramped working space. The thermal transfer recording apparatus 10 uses a film coated with a thermal subliming ink. Such a paper as the photographic printing paper which shows strong stiffness and has a large thickness (150–250 $\mu$m) is used as a recording paper for producing an image by trapping the sublimed ink.

Figure 3:
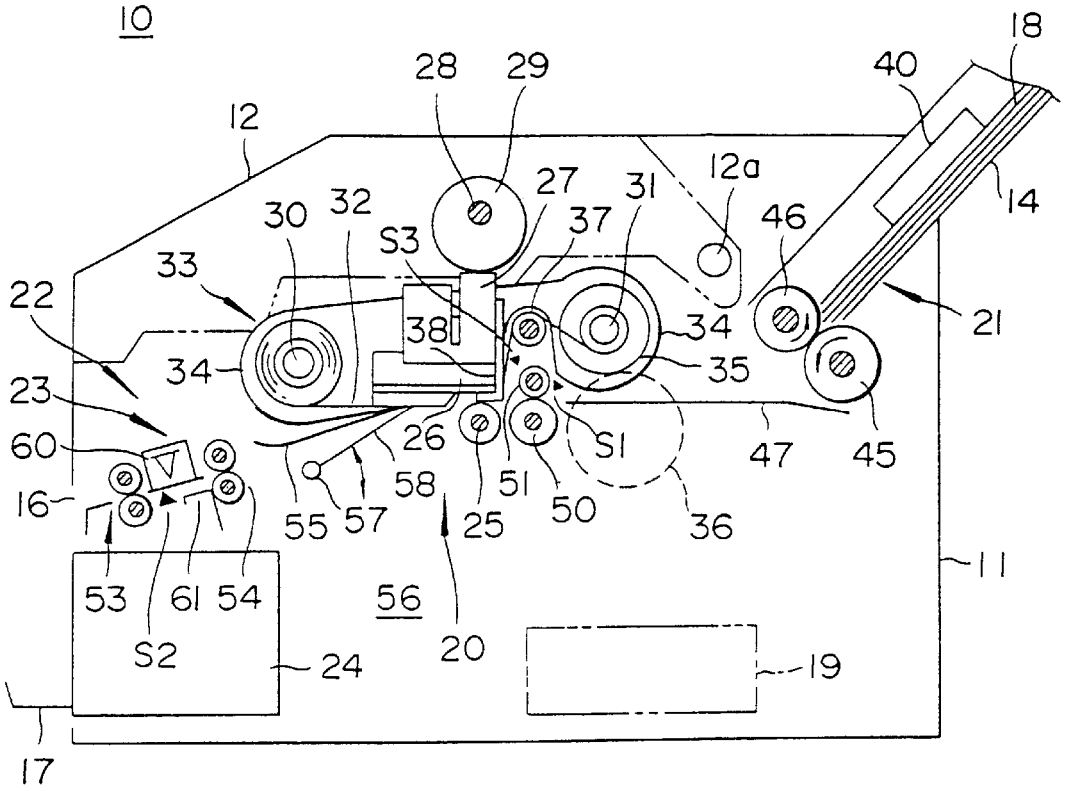
FIG. 3 is a schematic cross section illustrating the inner arrangement of the apparatus in a state having the ink film cassette.
Figure 4A:
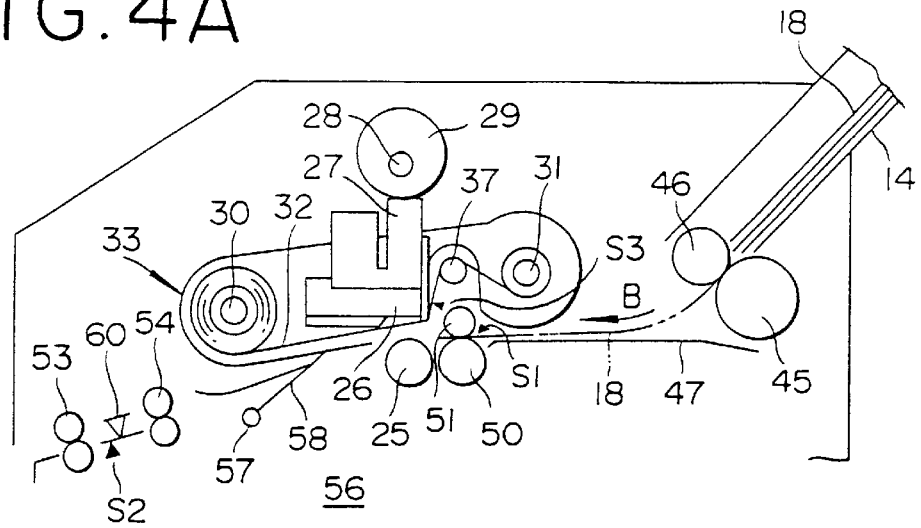
FIGS. 4A–4C are cross sections schematically illustrating the operation of the apparatus.
Figure 4B:
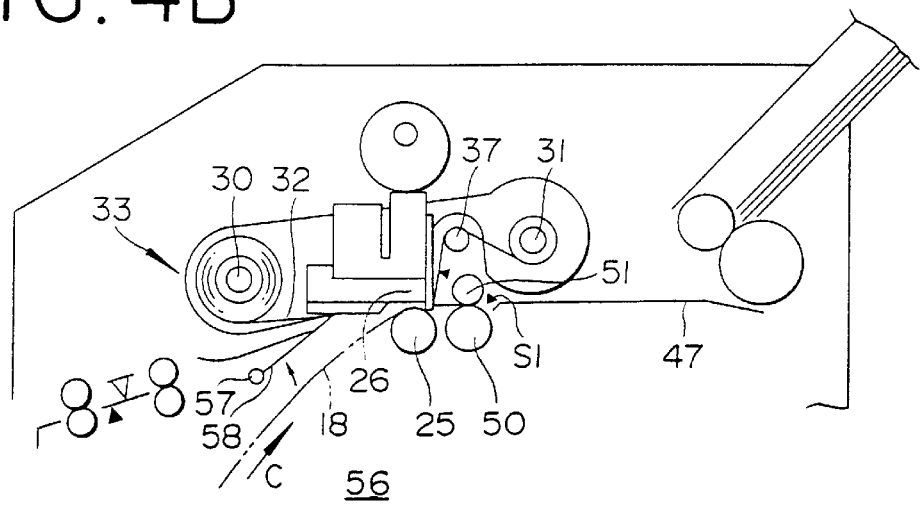
Figure 4C:
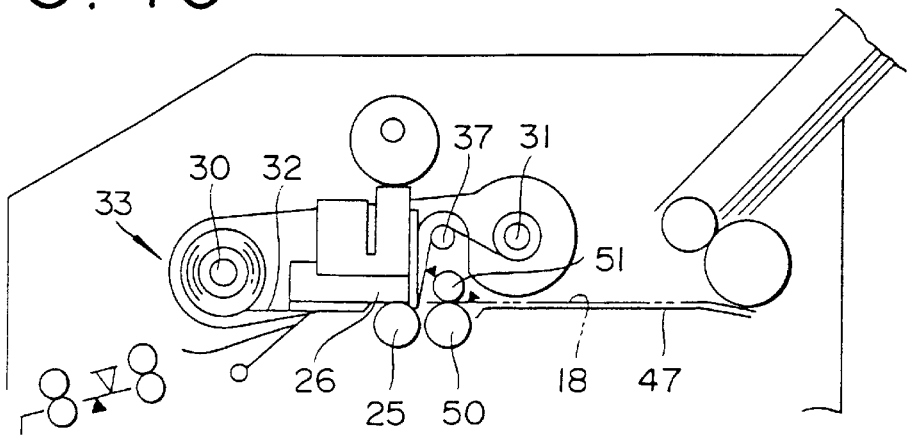

FIG. 2 is a schematic cross section illustrating the inner arrangement of the thermal transfer recording apparatus with a lid in an opened state, FIG. 3 is a schematic cross section illustrating the inner arrangement of the thermal transfer recording apparatus in a state having the ink film cassette mounted thereto, and FIGS. 4A–4C are cross sections schematically illustrating the states of operation of the thermal transfer recording apparatus respectively during the supply of paper, at the start of printing and at the end of printing.

First, the inner arrangement of the thermal transfer recording apparatus 10 will be outlined. As illustrated in FIG. 2 and FIG. 3, the thermal transfer recording apparatus comprises a printing section 20 positioned roughly in the central section of the main body for conveying a recording paper 18 in a parallel pattern, the feeder section 21 positioned on the rear surface side of the main body and disposed above the printing section 20 as slanted with an angle of about 45 degrees, and a output section 22 opposed to the feeder section 21 across the printing section 20. The arrangement of the printing section 20 with the parallel conveyance system exalts the quality of the print on the recording paper 18 of a large thickness and strong stiffness The aslant disposition attains a saving on the floor space required for the installation of the thermal transfer. recording apparatus. Further, the placement of the output section 22 opposed to the feeder section 21 across the printing section 20 enables the thermal transfer recording apparatus to offer the convenience of the sort experienced in the use of a facsimile device and assume the shape with enhanced acceptability for the user. The output section 22 is provided with a cutter unit 23. The dust holder 24 is disposed below the cutter unit 23. A control unit 19 is also integrated into the thermal transfer recording apparatus. The control unit 19 executes required image processing operations on the image signal inputted by an external control device and controls the operation of the thermal transfer recording apparatus 10.

Next, the inner arrangement of the thermal transfer recording apparatus 10 will be described in detail. A platen roller 25 is supported rotatably in the housing 11. A head base 27 with a thermal head 26 is attached to the inner surface side of the lid 12 so as to be movable toward and away from the platen roller 25. The thermal head 26 is moved until it is pressed against the platen roller 25 when the head base 27 is advanced toward the platen roller 25. The thermal head 26 is separated from the platen roller 25 when the head base 27 is moved away from the platen roller 25. The head base 27 is, by such resilient means as a spring (not shown), urged in the direction indicated by an arrow mark A in FIG. 2 so that the thermal head 26 may be held at a position away from the platen roller 25 or at a pressure release position.

An eccentric cam 29 for pressurization is fixed to a drive shaft 28 attached rotatably to the lid 12. The eccentric cam 29 comes in contact with and moves forward the head base 27 when a drive motor Ml drives the drive shaft 28 to rotate. Namely, the thermal head 26 is pressed against the platen roller 25. Incidentally, the lid 12 is fastened to the housing 11 by such engaging means as a pin (not shown) when the lid 12 is closed.

An ink film 32 in the shape of a ribbon, which is to be paid out of a supply reel 30 and wound on a take-up reel 31, is conveyed between the thermal head 26 and the platen roller 25 as illustrated in FIG. 3. The ink film 32 is formed by sequentially applying ink layers of the three colors, yellow, magenta, and cyan to a base film in the order. The ink film, when necessary, may additionally use a white ink or a top coating agent. The ink film 32, when not yet used, is being wound on the supply reel 30. The used part is wound on the take-up reel 31 as the ink film 32 is used.

The two reels 30, 31, respectively on the supply side and the take-up side, are received in an ink film cassette 33. This cassette 33, which is detachable relative to the housing 11, is mounted at a desired position, or is set on a holding plate 34 which is fixed to the interior of the housing 11. Part of a gear 35 fixed on the take-up reel 31 confronts an opening formed in the cassette 33. A drive gear 36 for winding an ink film, which is disposed in the main body of the apparatus, is engaged with the gear 35 when the ink film cassette is set in place. A motor M2 rotates the drive gear 36. The arrangement of the cassette 33 will be described in detail herein below.

A winding roller 37 is rotatably disposed at a position at which the winding roller 37 is located inside the cassette 33 when the ink film cassette is mounted, for the purpose of forming a path for the conveyance of the ink film 32. The winding roller 37 has the surface formed of a rubbery material with high friction resistance and is rotated by a winding motor M3 as a pulse motor. An electromagnetic clutch (not shown) is interposed between the winding motor M3 and the winding roller 37. The electromagnetic clutch is turned on only when the positioning of the start point of the ink film 32 is done while the thermal transfer recording apparatus is not during the printing operation, namely the thermal head 26 is kept apart from the platen roller 25. And the electromagnetic clutch is turned off in any other state such as when the thermal transfer recording apparatus is at printing.

The thermal head 26 is pressed against the platen roller 25 during the printing operation. The ink film 32, by the friction force with the recording paper 18 conveyed between the platen roller 25 and the thermal head 26, is drawn out of the supply reel 30 and conveyed at the same speed as that of the motion of the recording paper 18. The motor M2 rotates the take-up reel 31 through the drive gear 36 and the gear 35. In consequence, the ink film 32 paid out of the supply reel 30 is guided by a guide plate 38 disposed at the leading end of the thermal head 26 and the winding roller 37, and wound on the take-up reel 31. The electromagnetic clutch is turned off during this printing operation. Thus, the winding roller 37 follows the motion of the ink film 32 and functions as a guide roller for directing the conveyance of the ink film 32.

The thermal head 26 is kept apart from the platen roller 25 during the absence of the printing operation. The electromagnetic clutch is turned on and the winding motor M3 rotates the winding roller 37 when the start point of the ink film 32 is positioned in this state. As a result, the ink film 32 is drawn out of the supply reel 30 and wound on the take-up reel 31 by the friction force which is generated between the ink film 32 and the winding roller 37 that is driven to rotate.

The recording paper 18 is held in a slanted state on the paper tray 14. The paper tray 14 is provided with a width regulating plate 40, which regulates the recording paper 18 in the direction of width. This width regulating plate 40 is allowed to slide in the direction of width, depending on the size of the recording paper 18. A cover 41 (FIG. 1), which prevents dirt from adhering to the recording paper 18, is attached to the paper tray 14 so as to be opened and closed around a hinge (not shown). The cover 41 is formed of such a transparent material as acrylic resin in order that the residue of recording paper 18 in the paper tray 14 may be visually discerned from outside. The reference numeral "43" in FIG. 1 denotes a handle used in opening and closing the cover 41.

A feeding roller 45 and a separating roller 46 disposed as opposed to the feeding roller 45 across a minute gap feed the stack of recording papers 18 held on the paper tray 14 one by one, and then is conveyed as guided by a guide 47. A feeding motor M4 as a pulse motor rotates the feeding roller 45.

A grip roller 50 and a pinch roller 51 in contact with the grip roller 50 are disposed adjacent to the platen roller 25 on the upstream side of the platen roller 25. The recording paper 18 fed from the paper tray 14 is advanced into the gap between the two rollers 50, 51. A drive motor M5 as a pulse motor rotates the grip roller 50. The pinch roller 51 is rotated by following the conveyance of the recording paper.

First paired discharge rollers 53 positioned on the side of the outlet 16 and second paired discharge rollers 54 positioned on the side of the platen roller 25 are disposed as separated from each other by a fixed distance on the downstream side of the platen roller 25 for outputting the recording paper 18 onto the output tray 17. A conveying motor M6 as a pulse motor rotates these paired discharge rollers 53, 54. A guide 55, which guides the recording paper 18 in the output process, is provided between the platen roller 25 and the paired discharge rollers 53, 54. A space 56, which holds the recording papers 18 during the printing operation, is formed below the guide 55.

The reproduction of a color image on the recording paper 18 will be explained concerning the illustrated thermal transfer recording apparatus 10. First, the recording paper 18 is fed out of the paper tray 14 as illustrated in FIG. 4A, advanced in the direction indicated by an arrow mark B, and set in the space 56 as illustrated in FIG. 4B. Then, the recording paper 18 is returned from the position in the direction indicated by an arrow mark C while being given a yellow image. The recording paper 18 is conveyed to the guide 47 as shown in FIG. 4C. Accordingly, this operation is referred to as a "return printing method". After the yellow image has been transferred to the recording paper 18 in return conveyance, the recording paper 18 is advanced in preparation for the reproduction of the image in the color of magenta. The multi-color image is formed on the recording paper 18 by transferring monochromatic images with, for example, three colors by the frame sequential method. It is only at the time of return conveyance that the thermal head 26 is pressed against the platen roller 25. The thermal head 26 is separated from the platen roller 25 while the recording paper 18 is in forward conveyance. The grip roller 50 and the pinch roller 51 continue to nip the recording paper 18 when the return conveyance and the forward conveyance are repeated for printing.

A rocking guide 58 is, below the guide 55, disposed swingably around a supporting shaft 57, so as to guide the recording paper 18, which is conveyed by the grip roller 50 and the pinch roller 51, selectively to either the output section 22 provided with the paired discharge rollers 53, 54, etc., or the space 56. The rocking guide 58 is formed of a flexible material. The recording paper 18, which is conveyed by the grip roller 50, etc., is received into the space 56 when the rocking guide 58 is swung to an upper position as illustrated in FIG. 4B. The recording paper 18 is conveyed toward the output section 22 when the rocking guide 58 is swung clockwise from the upper position to a lower position around the supporting shaft 57 as the center.

The cutter unit 23 as the paper-cutting section is interposed between the first paired discharge rollers 53 and the second paired discharge rollers 54. This cutter unit 23 comprises a rotary cutter 60 and a cradle 61, which cooperates with the cutter 60 and cuts the recording paper 18. The scraps or cut-off which is removed from the recording paper, falls under their own weight into the dust holder 24 disposed below the cutter unit 23. The dust holder 24 can be drawn in and out of the housing 11. The dust holder 24 is opened on the upper side, and has at least the front surface formed of such a transparent material as acrylic resin for visually discerning the amount of the stored scraps from outside of the thermal transfer recording apparatus 10. The reference numeral "62" used in FIG. 1 denotes an opening formed in the upper part of the front surface of the dust holder 24 as a handle. The user, with his finger locked in the handle 62, draws the dust holder 24 from the housing 11 and removes scraps of paper stored in the dust holder 24.

A sensor S1, which detects the leading end of the recording paper during the supply of paper or the trailing end of the recording paper during the printing operation, is disposed adjacently to the grip roller 50 as illustrated in FIG. 3. The sensor S1 outputs an ON-signal when it has detected the leading end or the trailing end of the recording paper 18. Since the sensor S1 detects the trailing end of the recording paper during the printing operation, it will be referred to in the following description as a "trailing end sensor S1" for the sake of convenience.

A leading end sensor S2, which detects the leading end of the recording paper, is disposed in the cutter unit 23, as illustrated in FIG. 2. The leading end sensor S2 outputs an ON-signal when it has detected the leading end of the recording paper 18. The pulses for driving the conveying motor M6 are controlled on the basis of the time at which the leading end sensor S2 detects the leading end of the recording paper 18. And the pulses are used for the leading end cut as cutting a desired length of the recording paper 18 from the leading end, and the trailing end cut as cutting a desired length of the recording paper 18 from the trailing end.

A mark sensor S3, which detects a start mark arranged on the ink film 32, is disposed adjacently to the film guide roller 37 as illustrated in FIG. 3. The start mark is deposited photographically in the leading end part of the yellow ink area. The positioning of start point of the ink film 32 is composed of turning on the electromagnetic clutch, rotating the winding roller 37 with the winding motor M3, generating friction force between the ink film 32 and the winding roller 37, and conveying the ink film 32 with the friction force. This positioning is carried out during the forward conveyance of the recording paper 18 until the training end sensor S1 detects the trailing end of the fed recording paper 18. The next positioning of the ink layer of the subsequent color is composed of turning on the electromagnetic clutch, causing the winding roller 37 to convey the ink film 32 with the friction between the ink film 32 and the winding roller 37, and measuring the conveying length of the ink film 32 in terms of the number of pulses by means of an encoder (not shown) which is disposed at one end of the winding roller 31.

Reflection type photo-sensors may be cited as concrete examples of the sensors S1, S2 and S3. These sensors S1, S2 and S3 do not need to be limited to the reflection type photo-sensors. Transmission type photo-sensors may be used instead.

The control unit 19 is disposed in the below interior of the thermal transfer recording apparatus as shown FIGS. 2, 3. The control unit 19 is connected to an external power unit, receives signals outputted from the external control device (not shown) through the interface, and controls the operation of the thermal transfer recording apparatus 10.

<<Arrangement of Ink Film Cassette>>

Figure 5:
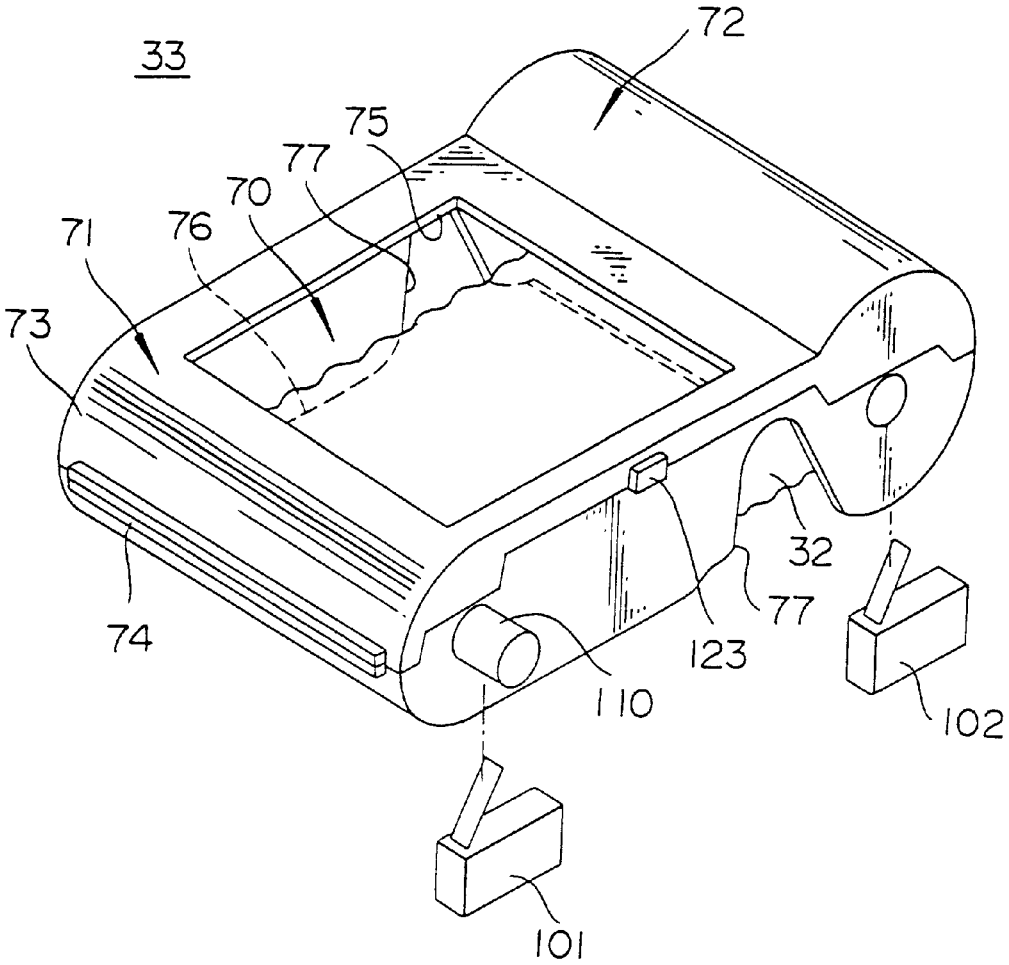
FIG. 5 is a perspective view schematically illustrating the cassette according to the first embodiment, and a limit switch disposed in the apparatus for identifying the types of ink film.

Next, the arrangement of the cassette 33 will be described in detail. FIG. 5 is a perspective view schematically illustrating the cassette according to the first embodiment and a limit switch for identifying the types of ink film disposed in the apparatus. Incidentally, action, etc. of the limit switch will be described herein below.

The cassette 33 is provided with a film guide 70, which is centrally disposed, and a supply reel holder 71, which is formed at one end, and a take-up reel holder 72, which is formed at the other end, as illustrated in FIG. 5. These parts are assembled by mutually abutting an upper frame 73 and a lower frame 74, which are severally formed of synthetic resin. An upper opening 75 and a lower opening 76 are respectively formed in the upper and the lower wall of the film guide 70 in the drawing. Notches 77 for receiving the winding roller 37 are formed in the lateral walls of the lower frame 74.

Figure 6:
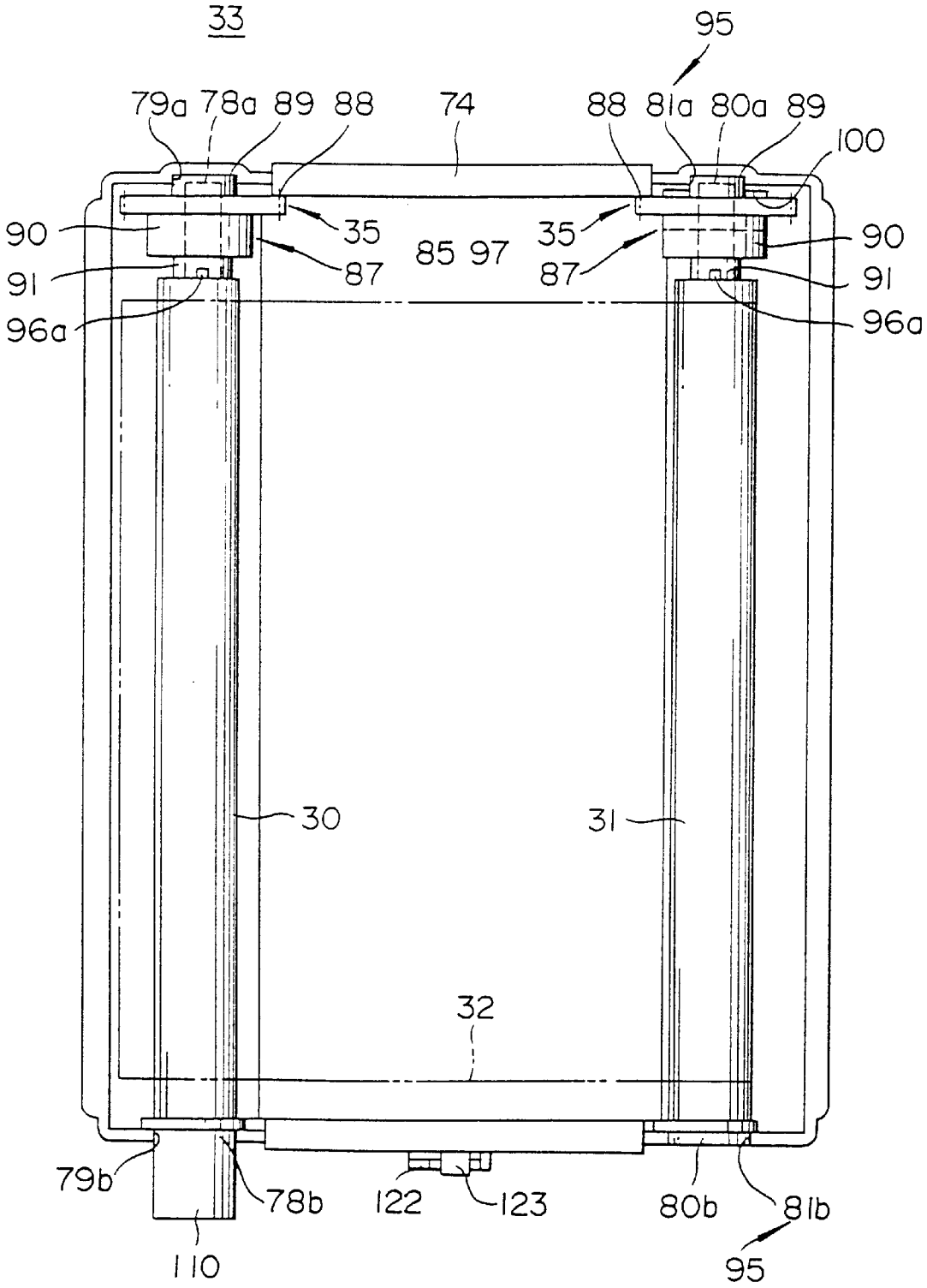
FIG. 6 is a plan view illustrating the state in which relevant reels are mounted to a lower frame of the cassette.
Figure 7:
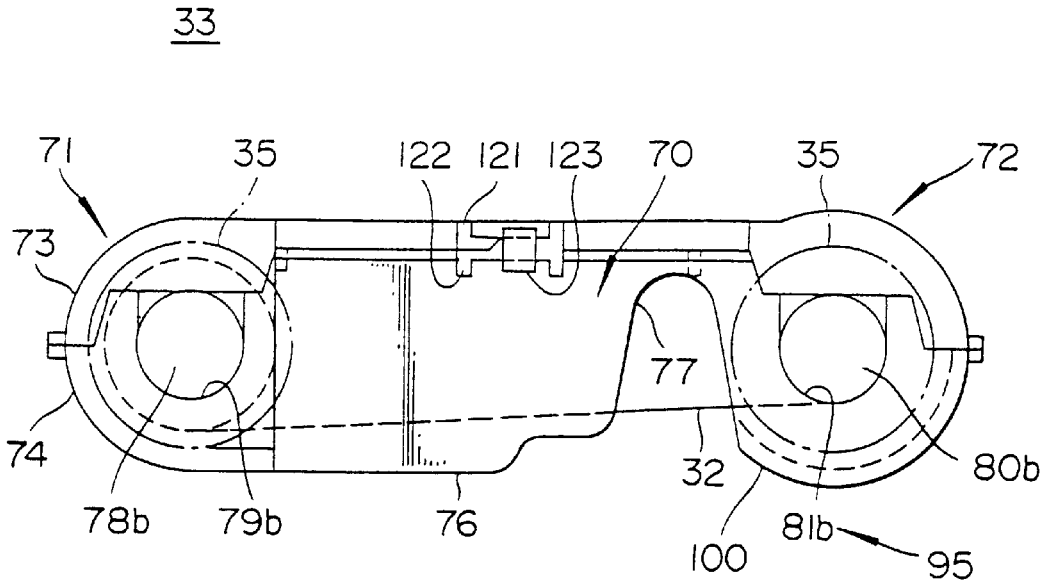
FIG. 7 is a side view illustrating the ink film cassette.

As illustrated in FIG. 6 and FIG. 7, the supply reel 30 with the wound ink film 32 is set in the supply reel holder 71 and the take-up reel 31 is set in the take-up reel holder 72.

Supporting shafts 78*a* and 78*b* are disposed at the opposite ends of the supply reel 30. A supply side bearing 79*b*, which is formed on the lateral walls of the upper and lower frames 73 and 74, rotatably supports the supporting shaft 78*b* shown on the lower side in FIG. 6. Similarly, supporting shafts 80*a* and 80*b* are disposed at the opposite ends of the take-up reel 31. A take-up side bearing 81*b* , which is formed on the lateral walls of the upper and lower frames 73 and 74, rotatably supports the supporting shaft 80*b*. A first torque limiter 85 and a second torque limiter 97 which will be described specifically herein below, rotatably supports the other supporting shafts 78*a* and 80*a* of the reels 30, 31 respectively.

The take-up reel holder 72 is formed with a larger outside diameter than the supply reel holder 71 is. Owing to this differentiation in shape, the mounting direction can be easily discerned during the mounting of the cassette 33 to the main body of the thermal transfer recording apparatus. The cassette in this shape is easily taken by the user and does not allow easy access to the ink film 32 when it is held in the user's hand. After the printing, the ink film 32 has formed wrinkles. Therefore, the roll diameter of the take-up reel 31 is inevitably larger than the initial roll diameter of the supply reel 30 when the ink film 32 is perfectly transferred from the supply reel 30 to the take-up reel 31. The increase in the roll diameter after printing produces no problem when the outside diameter of the take-up reel holder 72 is larger than that of the supply reel holder 71.

Figure 8:
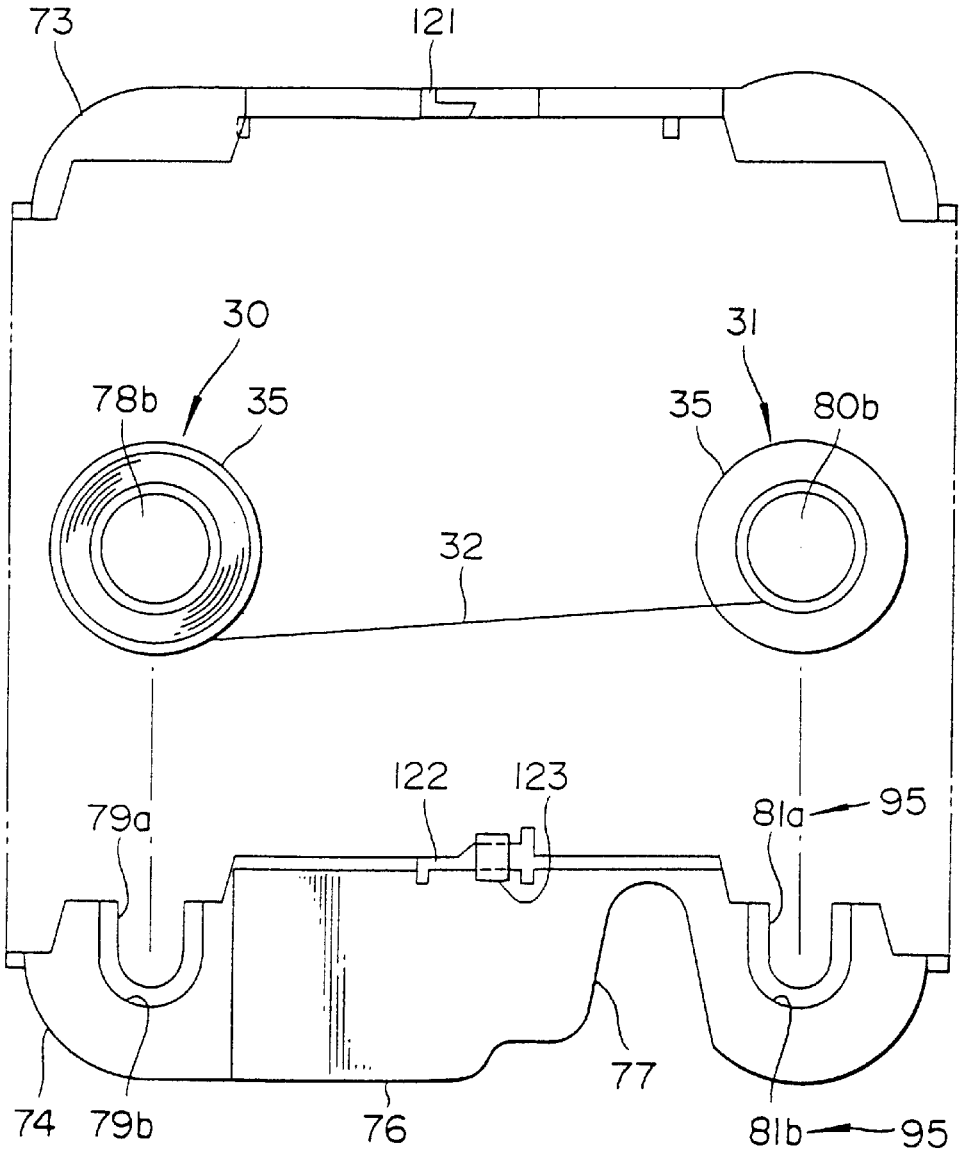
FIG. 8 is a side view illustrating the state in which the ink film is detached by opening the upper and the lower frame of the cassette.

The upper and lower frames 73 and 74 of the cassette 33 are so formed as to be freely opened and closed. As illustrated in FIG. 7, engaging pieces 121, 122 are formed and a slider 123 for linking and unlinking the two engaging pieces 121, 122 is disposed movably in the lateral sides of the upper and lower frames 73 and 74. The two engaging pieces 121, 122 of the upper and lower frames 73 and 74 are abutted and then the slider 123 is moved in the left direction as in the diagram. In consequence, two engaging pieces are engaged and the upper and lower frames 73 and 74 are fastened to each other. The two engaging pieces can be disengaged and the upper and lower frames 73 and 74 can be opened when the slider 123 is moved in the right direction as in the diagram. The state in which the upper and lower frames 73 and 74 are opened is as illustrated in FIG. 8. The slider 123 remains on the lower frame 74 even when the upper and lower frames 73 and 74 are opened.

The first torque limiter 85, which transmits braking force to the supporting shaft 78*a* of the supply reel 30 in the cassette 33, is interposed detachably between the supporting shaft 78*a* of the supply reel 30 and the cassette 33. Further, braking unit 95, which transmits braking force to the supporting shafts 80*a* and 80*b* of the take-up reel 31 in the cassette 33, is interposed detachably between the supporting shafts 80*a* and 80*b* of the take-up reel 31. Furthermore, the cassette 33 is provided with the second torque limiter 97, which limits the driving torque of the take-up reel 31 in the cassette 33.

The first torque limiter 85 is composed of a gear 35 and a limiter 87 attached to the gear 35, as illustrated in FIG. 6 and FIG. 9. The gear 35 includes a disc 88 having teeth formed on the outer peripheral surface and an axis 89 formed integrally with the disc 88. The limiter 87 has a housing 90 as a main body and an inner shaft 91, which is rotatably kept in a through hole formed in the housing 90. The disc 88 of the gear 35 and the housing 90 of the limiter 87 are fixed to each other and are integrally rotatable. Through holes into which the supporting shaft 78*a* of the supply reel 30 is inserted are respectively formed in the inner shaft 91 and the gear 35. The supporting shaft 78*a* is formed in a smaller diameter than the supply reel 30. A raised portion 96*a* extended in the direction of diameter is formed on the end surface 30*a* of the supply reel 30. A pressed portion 96*b* matched to the raised portion 96*a* is formed at the leading end of the inner shaft 91. The supply reel 30 and the inner shaft 91 are jointly rotated when the raised portion 96*a* and the pressed portion 96*b* (hereinafter jointly referred to as an "engaging portions 96") are engaged together.

Two through holes (not shown) extended in the direction of diameter are formed in a piercing manner in the housing 90 of the limiter 87. A spring is set in the through holes. A set-screw is pushed in an opening edge of the through hole. The two through holes are formed at mutually confronting positions. The resilient force of the spring acts on the inner shaft 91 from opposite radial directions.

The attachment of the first torque limiter 85 to the supply reel 30 includes of inserting the first torque limiter 85 into the supporting shaft 78*a* from the side of the inner shaft 91, positioning and engaging the raised portion 96*a* and the pressed portion 96*b*, and coupling the supply reel 30 and the inner shaft 91 through this engaging portions 96. The first torque limiter 85 inserted into the supporting shaft 78*a* is fixed in a state incapable of rotation relative to the cassette 33. In other words, the fixation and the support of the first torque limiter 85 are carried out by nipping the gear 35 as one of composing elements of the second torque limiter 97, with the upper and lower frames 73 and 74 having a protrusion which is formed on an inner surface and corresponds to the shape of a gear tooth, for example. When the first torque limiter 85 is in this state, the resilient force of the spring acts on the inner shaft 91 from the opposite radial directions. And this resilient force also acts on the supply reel 30 which is connected to the first torque limiter 85 through the engaging portions 96. As a result, the supply reel 30 is not rotated unless any torque overcoming the resilient force of the spring acts on the supply reel 30. In short, the first torque limiter 85 confers a rotational load on the supply reel 30 by transmitting braking force to the supporting shaft 78*a* of the supply reel 30 inside the cassette 33. Incidentally, the adjustment of the rotational load can be easily accomplished by controlling the amount of insertion of set-screws 126. Since the second torque limiter 97 is identical in arrangement with the first torque limiter 85, it will be omitted from the following detailed illustration and description. The gear 35 of the second torque limiter 97 is so disposed as to confront an opening 100 formed in the lower frame 74 (FIG. 6 and FIG. 7). In the manner as described above, the gear 35 is engaged with the drive gear 36 for winding an ink film, through the opening 100 when the cassette 33 is mounted into the main body of the thermal transfer recording apparatus.

The second torque limiter 97 can be mounted to the take-up reel 31 in the same manner as the first torque limiter 85. Accordingly, the first and second torque limiters 85 and 97 can be easily attached and detached t o the supporting shafts 78*a* and 80*a*, respectively. The second torque limiter 97 inserted into the supporting shaft 80*a* is fixed in a state capable of free rotation relative to the cassette 33. When the second torque limiter 97 is in this state, the resilient force of the spring acts on the inner s haft from the opposite radial directions and also acts on the take-up reel 31 which is connected to the second torque limiter 97 through the engaging portions 96. As a result, the rotational force arising from the gear 35 is not transmitted to the take-up reel 31 and the gear 35 alone is idly rotated when driving torque, which is greater than the force equivalent to the resilient force of the spring, happens to act on the gear 35.

The braking unit 95 is composed of the take-up side bearings 81*b*, which supports the supporting shaft 80*b* of the take-up reel 31, and the take-up side bearing 81*a*, which supports the gear shaft 89 into which the supporting shaft 80*a* is inserted, as illustrated on a enlarged scale in FIG. 6. The clearances between the take-up side bearing 81*b* and the supporting shaft 80*b* and between the take-up side bearing 81*a* and the gear shaft 89 are so designed to be at a desired size as to transmit braking force to the supporting shaft 80*b* and the gear shaft 89 and give a rotational load on the take-up reel 31.

The supply side bearing 79*b*, which supports the supporting shaft 78*b* of the supply reel 30, and the supply side bearing 79*a*, which supports the gear shaft 89 into which the supporting shaft 78*a* is inserted, are so formed as to reduce the slide resistance between the supporting shaft 78*b* and the gear shaft 89 to the fullest possible extent.

The braking unit 95 transmits the rotational load to the take-up reel 31. For that reason, the torque of the second torque limiter 97 on the take-up side is set in consideration of the rotational load on the take-up reel 31. Specifically, the torque of the first torque limiter 85 on the supply side is greater than that of the second torque limiter 97.

The provision of the torque limiters 85,97 in the ink film cassette has the following advantage. The thermal transfer recording apparatus 10 using this cassette 33 does not require the supply side torque limiter and the take-up side torque limiter to be installed within the main body of the recording apparatus 10. The torque limiters 85,97 provided within the ink film cassette 33 do not require having the same durability as other parts or components provided within the ink film cassette 33.

The first torque limiter 85, which transmits braking force to the supporting shaft 78*a* of the supply reel 30, is provided within the cassette 33. Accordingly, there is no possibility that the ink film.32 will slack and immediately run out of the supply reel 30 under the influence of an external force during the distribution of the ink film cassette as a consumable product. And, the unused ink film 32 will not be wasted. By the same token, there is no possibility that the unused ink film 32 will immediately run out of the supply reel 30 under the influence of an external force and be wasted when the cassette 33 is removed from the apparatus 10 before the ink film 32 has been completely used up.

Further, the braking unit 95, which is composed of the take-up side bearings 81*a* and 81*b*, also gives the rotational load on the take-up reel 31 in the cassette 33. Thus, there is no possibility that the used ink film 32 will immediately run out of the take-up reel 31 under the influence of an external force and be damaged as when the cassette 33 with the ink film 32 that has been completely used up, is removed from the apparatus.

The torque of the first torque limiter 85 on the supply side is set greater than that of the second torque limiter 97 on the take-up side. The ink film 32 in a slacked state is wound on the take-up reel 31 and caused to assume a taut state when the take-up reel 31 is set rotating. However, there is no possibility of the ink film 32 being drawn out of the supply reel 30 when the take-up reel 31 is further rotated. Because the driving torque acting on the gear 35 surpasses the resilient force of the spring and thereby the gear 35 alone may make an idle rotation. The unused ink film 32 is not drawn out of the supply reel 30, but the used ink film 32 is drawn out of the take-up reel 31 when the thermal head 26 is lowered and pressed against the platen roller 25 in preparation for the printing operation. Thus, the unused ink film 32 will not be wastefully used.

Figure 9A:
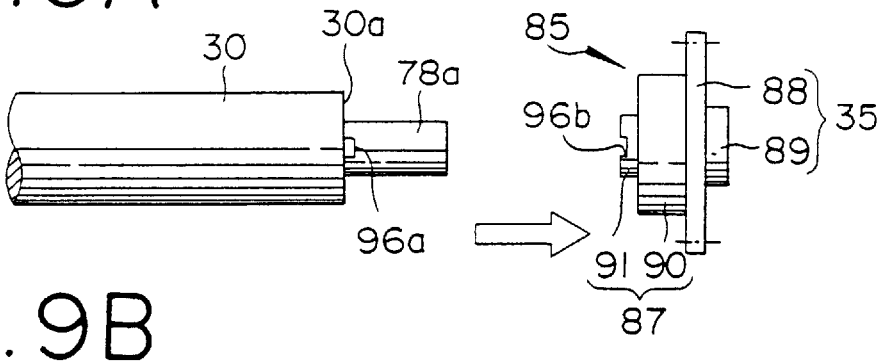
FIG. 9A and FIG. 9B are diagrams illustrating an artist's concept of the procedure of the work of replacing the torque limiter to a newly supplied reel.
Figure 9B:
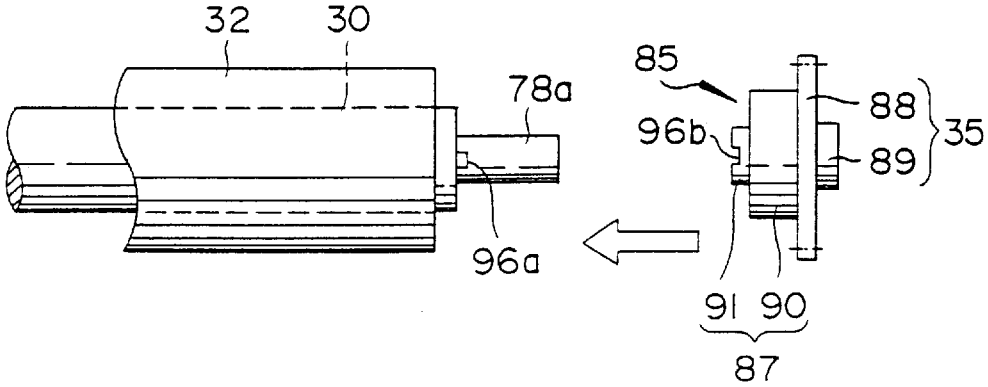

The torque limiters 85 and 97 can be set in and detached from the cassette 33 in conjunction with the reels 30, 31 and be easily attached to and detached from the supporting shafts 78*a* and 80*a*. Thus, the first torque limiter 85 can be removed from the spent supply reel 30, as illustrated in FIG. 9A. And, this first torque limiter 85 can be attached to a new supply reel 30 and readily set in the cassette 33, as illustrated in FIG. 9B. The second torque limiter 97 can be attached to a new take-up reel 31 and readily set in the cassette 33 in the same manner, though not illustrated in the diagram. The user, therefore, can perform all by himself the work of refilling the ink film 32.

Incidentally, the first torque limiter 85, the second torque limiter 97 and the braking unit 95 do not need to be limited to the above-mentioned arrangements but may be variously modified.

The first torque limiter 85, for example, may be designed to comprise an elastic material such as a sponge that makes sliding contact with the periphery of the supporting shaft 78*a* of the supply reel 30 and gives a rotational load on the supply reel 30, which is detachably fitting to the inner surface of the cassette 33.

<<Reel>>

Figure 10A:
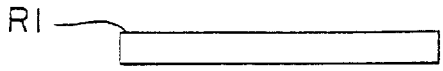
FIG. 10A and FIG. 10B are diagrams illustrating the models of two types of reels used on a reel on the supply side or a reel on the take-up side.
Figure 10B:
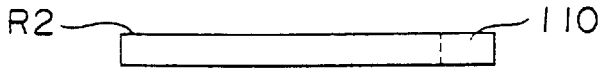

FIG. 10A and FIG. 10B are diagrams schematically illustrating two types of reels used as the supply reel 30 or the take-up reel 31. In these diagrams, supporting shafts 78*a*, 78*b*, 80*a* and 80*b* of the reels 30, 31 and the cores wound with a film are not specifically differentiated but are depicted in an equal diameter.

In the first embodiment with reference to FIG. 5, an extension 110, which is as a target or subject of detection and corresponds to the specific type of ink film, is provided in either of the edges of the supply reel 30 and/or the take-up reel 31, depending on the specific type of ink film. Specifically, two reels R1, R2 different in length are prepared as illustrated in FIG. 10. The reel R1 has an ordinary length such that the reel is snugly received inside the cassette and the edge does not unduly jut out of the casing of the cassette when inserted in a cassette. The reel R2 has a length such that the supporting shaft 78*b* and/or 80*b* protrudes to a desired distance from the casing when the reel is inserted in the cassette. In case of the specific type of ink film, the longer reel R2 is used for the supply reel 30 and/or the take-up reel 31. Thus, a portion of the longer reel R2 is protruded outward when the reel R2 is set in the cassette. The protruding portion constitutes itself the extension 110 as a target of detection.

In an cassette 33 illustrated in FIG. 5, the longer reel R2 is used for the supply reel 30 and the reel R1 of the ordinary length is used for the take-up reel 31. An edge detecting unit, which is provided in the main body of the apparatus, detects the extension 110 of the supply reel 30. This detecting unit is formed of a limit switch 101. The limit switch 101 comes in contact with the extension 110 of the supply reel 30 and is set being in an ON-state when the cassette 33 is mounted in the main body of the apparatus. An edge detecting unit as a limit switch 102 is disposed at an equivalent position on the take-up side in the main body of the apparatus. The limit switch 102 would be turned on if the longer reel R2 was used for the take-up reel 31. The edge detecting unit does not need to be limited to the limit switch but may be a photosensor, for example.

Figure 11A:
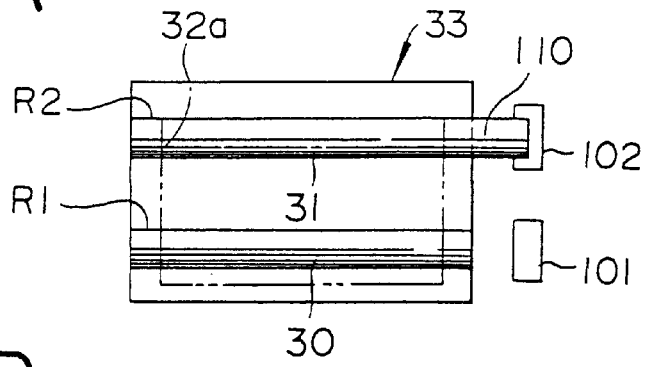
FIGS. 11A–11C are diagrams illustrating the relation between the length of a reel and the type of an ink film to be used.
Figure 11B:
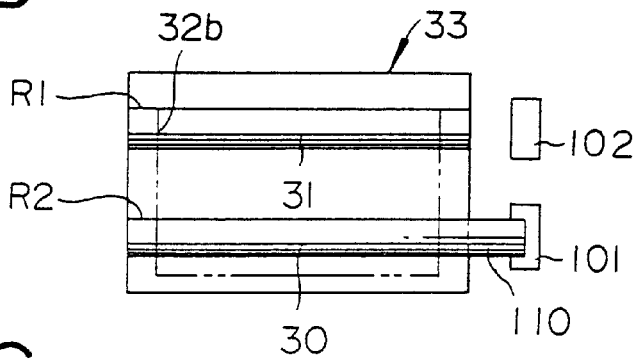
Figure 11C:
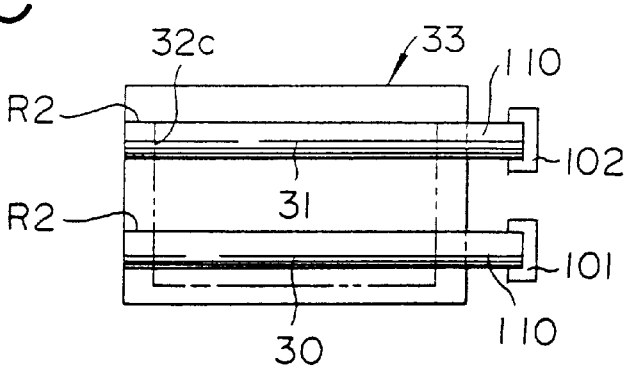

FIGS. 11A–11C are diagrams illustrating the relation between the length of a reel and the type of an ink film to be used. In the first embodiment, the controller judges that the cassette is not mounted in the thermal transfer recording apparatus when the limit switches 101, 102 are both in their OFF-state and judges that "the ink film is absent" when the cassette containing no ink film is mounted in the apparatus, for example.

The use of the two types of reel, namely the reel R1 of the ordinary length and the longer reel R2, permits identification of three types of ink film 32 (which refers collectively to the ink films 32*a*, 32*b* and 32*c* to be specifically described herein below). Specifically, the reel R1 of the ordinary length is used for the supply reel 30 and the longer Reel R2 is used for the take-up reel 31 in case of the ink film 32*a* as illustrated in FIG. 11A. The longer reel R2 is used for the supply reel 30 and the reel R1 of the ordinary length is used for the take-up reel 31 in case of the ink film 32*b* as illustrated in FIG. 11B and FIG. 5. And the longer reels R2 are used for both the supply reel 30 and the take-up reel 31 in case of the ink film 32*c* as illustrated in FIG. 11C. Therefore, the limit switch 101 is in OFF-state and the limit switch 102 is ON-state when the ink film 32*a* is used. The limit switch 101 is in ON-state and the limit switch 102 is OFF-state when the ink film 32*b* is used. And, the limit switches 101, 102 are both in ON-state when the ink film 32*c* is used. Based on the result of such a detection, thermal transfer recording apparatus easily can identify the types of ink film and detect the presence of an ink film in advance of the actuation of the internal mechanisms for the printing operation when the cassette 33 is inserted in the main body of the apparatus.

Figure 12:
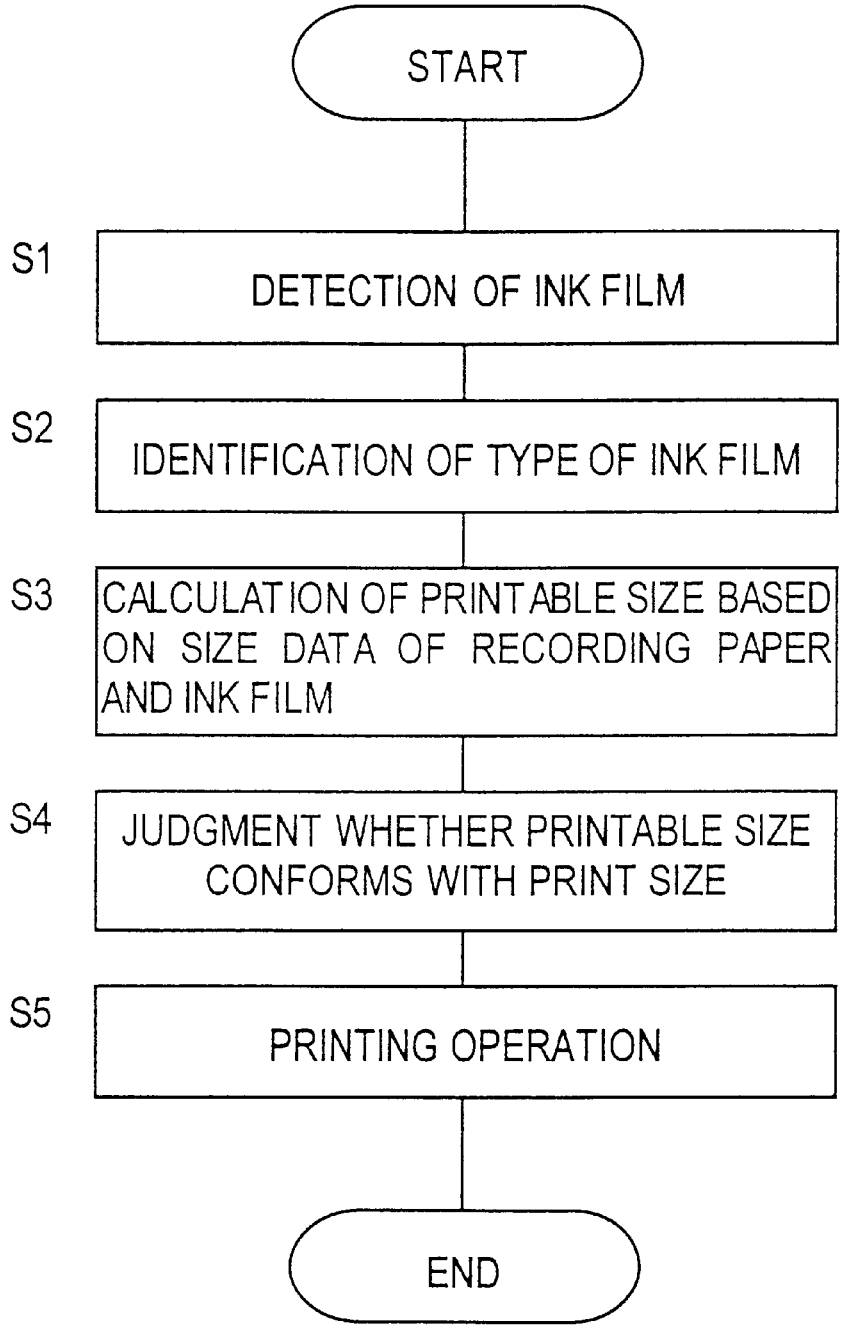
FIG. 12 is a flow chart illustrating the process of identifying a type of ink film and starting a printing operation.

Next, the process for identifying a type of ink film and starting the printing operation will be described below with reference to the flow chart illustrated in FIG. 12.

The power source for the apparatus is turned on and the cassette 33 is mounted in the main body of the apparatus. First, the control unit 19 judges whether the ink film is in existence in accordance with the result of the detection of the limit switches 101, 102 (step S1). When the limit switches 101, 102 are both in the OFF-state, the control unit 19 judges that the ink film is absent. Then, the control unit 19 turns on an LED in a red color, or outputs a message "NO INK FILM" on a display (not shown) in the main body of the apparatus for alarming an user.

In contrast, when not both of the limit switches 101, 102 are in OFF-state, the control unit 19 judges that the ink film is present (S1). Then, the control unit 19 identifies a type of ink film in accordance with the result of the detection of the limit switches 101 and 102, and output the type of film on the display (S2).

Then, the control unit 19 calculates printable dimensions based on the size data of a recording paper and an ink film (S3). A host computer, which is connected to the thermal transfer recording apparatus and inputs an image signal and a control signal to the apparatus, may calculates the printable size with the size data instead of the control unit 19.

The control unit 19 then judges whether the printable size determined at the step S3 conforms with the print size based on the data of printing transmitted from the host computer (S4). When the judgment denies the conformity, the control unit 19 outputs a message "PRINT SIZE IS LARGE" or "CHANGE TYPE OF INK FILM TO XX SIZE", for example, on the display for alarming a user (S4).

When the alarm is given at the step S1 or the step S4, the process does not proceed to the next step but waits until the reason for the alarm ceases to exist. When the alarm is absent or ceases to exist, the process advances to the step S5 and operations of the apparatus such as the printing are performed. The conveying distance of the ink film and the printing energy applied to the thermal head are set in accordance with the type of ink film identified at the step S2 for effecting formation of an appropriate image.

In the thermal transfer recording apparatus according to the first embodiment, the reel, which is provided with the extension 110 in at least one of the edges in the direction of axis, is set in the ink film cassette and the limit switches 101, 102 detect the extension 110. As a result, the type of the ink film wound around the reel and the erroneous mounting of the reel can be simply and easily discerned in advance of the printing operation when the ink film cassette is mounted in the main body of the apparatus. Further, the presence of the ink film can be detected by using the limit switches 101, 102 without requiring addition of an extra component.

The apparatus itself identifies a type of ink film, etc. in advance of the printing operation based on the result of the detection of the limit switches 101 and 102, and alarms the user and performs the printing operation, for example. It results in preventing the wasteful use of the ink film or the recording paper and doing the printing operation appropriate for the type of ink film.

Further, a type of ink film is identified not based on the shape of a cassette as the prior art but based on the shape of a reel wound with the ink film. Accordingly, it suffices to prepare one type of cassette for a plurality of types of ink film. In other words, it is no longer necessary to prepare ink film cassettes to be exclusively used for different types of ink film. And the user does not incur the trouble of ensuring coincidence between a type of ink film and a type of cassette proper for the type of ink film when replacing a spent ink film with a newly supplied ink film. The present embodiment, therefore, proves to be advantageous for use with the refill type ink film cassette in which the spent ink film may be replaced or refilled with a new supply.

Concerning FIGS. 11A–11C, the extension 110 can be disposed in two places, or one of the opposite edges of the supply reel 30 in the direction of its axis and one of the opposite edges of the take-up reel 31 in the direction of its axis. Optionally, the four positions, i.e. all the edges of the reels 30, 31 in the direction of their axes, may be used for the disposition of the extension 110. Namely, the apparatus can further increase the number of the distinguishable types of ink film by increasing the number of the extensions 110.

It is permissible to use any one of the four edges of the reels 30, 31 in the direction of the axes exclusively for the purpose of detecting an ink film. For example, the edge of the supply reel 30 on the side of the supporting shaft 78*a* is used exclusively for detecting an ink film and the other two or three edges are used for identifying a type of ink film. In this case, the extension is disposed in the edge of the supply reel 30 on the side of the supporting shaft 78*a* without reference to the type of ink film, and the limit switch for detecting this extension is disposed in the main body of the apparatus. Accordingly, the limit switch is not changed to be in ON-state even when the cassette is mounted. Namely, the absence of ink film can be easily discerned.

Figure 13:
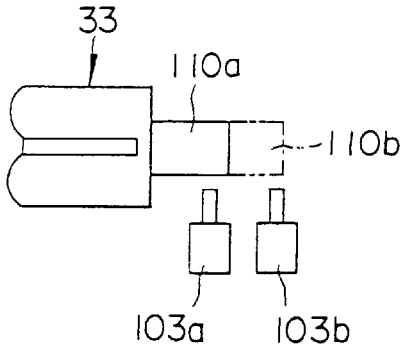
FIG. 13 is a plan view illustrating schematically a long reel having several stepped lengths set in an extension thereof and sensors for detecting the stepped lengths of the extension.

The method, which identifies a type of ink film based on the lengths of the reels wound with ink films, does not need to be limited to the arrangement that the two types of reel, i.e. the reel R1 of ordinary length and the longer reel R2, are assigned to the supply side and/or the take-up side in the manner described above. The method may be modified in various forms. To be specific, the length of an extension 110*a* is differentiated from the length of an extension 110*b* as illustrated in FIG. 13. And a type of ink film is identified based on the detection of the extensions 110*a*, 110*b* as by means of limit switches 103*a*, 103*b*. For example, it is discerned that the reel is provided with the longer extension 110*b* when the limit switches 103*a*, 103*b* are both in ON-state. In a word, the type of the ink film wound around the reel is identified. And, it is discerned that the reel is provided with the shorter extension 110*a* when the limit switch 103*a* is in ON-state and the limit switch 103*b* is in OFF-state. In short, a type of the ink film wound around the reel is identified.

Second Embodiment

Figure 14:
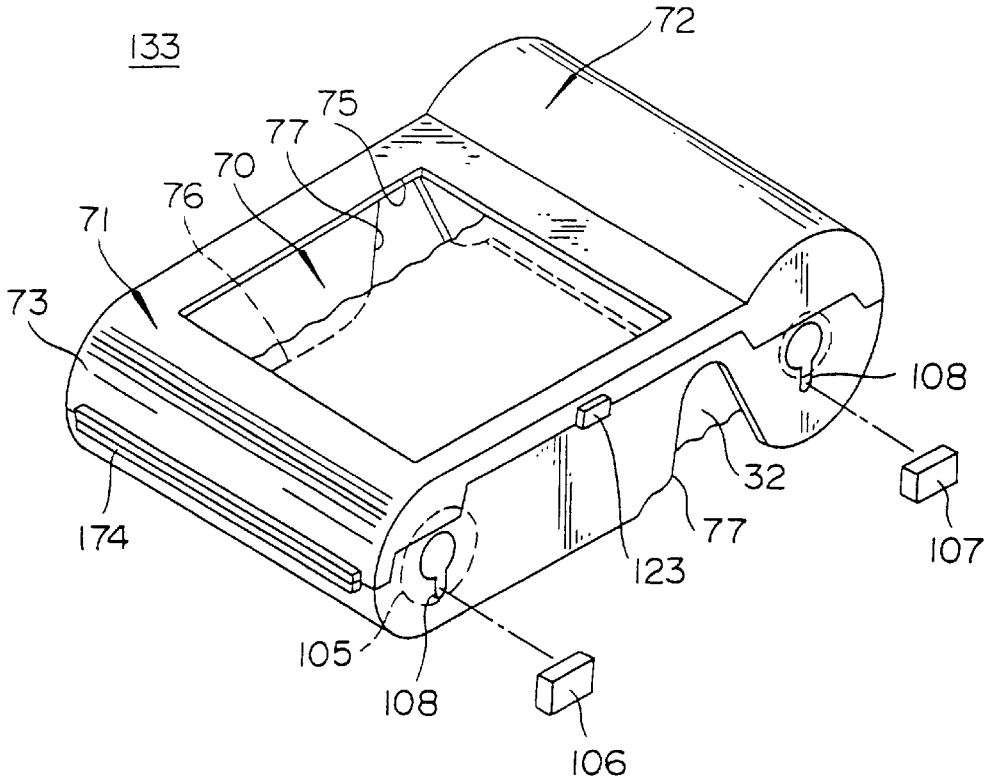
FIG. 14 is a perspective view illustrating schematically an ink film cassette according to the second embodiment and sensors, which are disposed inside a thermal transfer recording apparatus and used for identifying a type of ink films.
Figure 15:
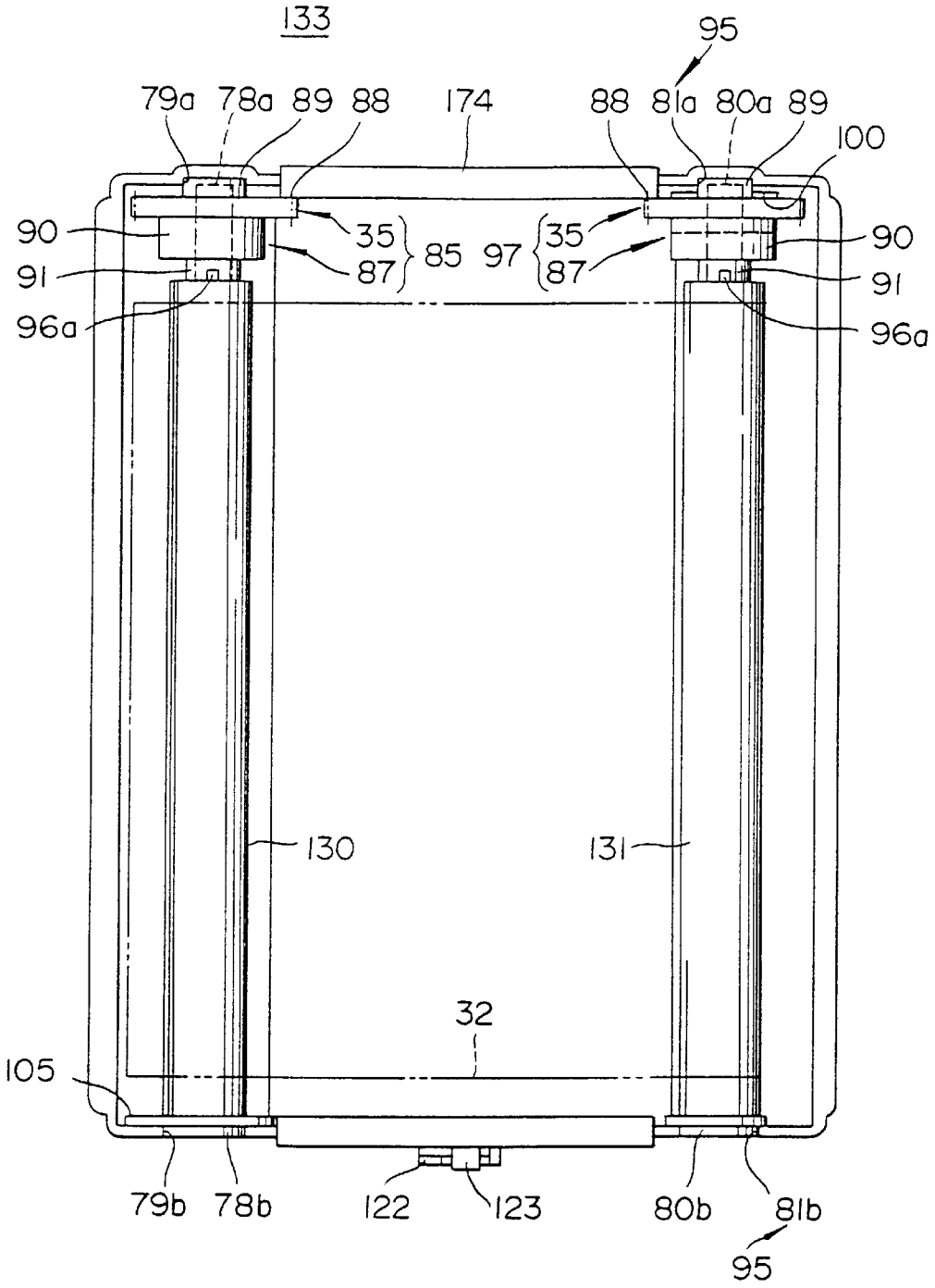
FIG. 15 is a plan view illustrating the state in which relevant reels are mounted to the lower frame of the cassette.

FIG. 14 is a perspective view schematically illustrating an ink film cassette according to the second embodiment, and sensors, which are used for identifying a type of ink film and disposed in the main body of a thermal transfer recording apparatus, and FIG. 15 is a plan view illustrating the state in which relevant reels are mounted to the lower frame of the cassette according to the second embodiment. In these diagrams, like members described in the first embodiment are denoted by like reference numerals and are omitted from the description herein.

The second embodiment differs from the first embodiment in respect that a flange 105, which is as a target or subject of detection and corresponds to the specific type of ink film, is provided in either of the edges of a supply reel 130 and/or a take-up reel 131, depending on the type of ink film. In the illustrated embodiment, the flange 105 is disposed on the supply reel 130 and not on the take-up reel 131. The flange 105 has a diameter larger than the diameter of the core (the portion wound with the ink film) of the reel 130 or 131. A notch 108 confronting the flange 105 is formed in a lower frame 174 of an ink film cassette 133. Photosensors 106, 107 as a detecting unit are disposed in of the main body of the apparatus, corresponding to the location of the notch 108.

The photosensor 106 detects the flange 105 disposed on the supply reel 130 through the notch 108 when the cassette 133 is placed in the main body of the apparatus. The photosensor 107 does not detect the flange 105. The identification of a type of the ink film and the detection of the ink film can be done in advance of the printing operation by utilizing the result of the detection of the flange 105 by the photosensors 106 and 107, similarly to the utilization of the result of the detection of the extension 110 of the reel in the first embodiment, Concerning FIG. 14 and FIG. 15, the flange 105 may be disposed in a total of two places, i.e. one of the opposite edges of the supply reel 130 in the direction of its axis and one of the opposite edges of the take-up reel 131 in the direction of its axis. Optionally, the four positions, i.e. all the edges of the reels 130, 131 in the direction of the axes, may be used for the disposition of the flange 105. Any one of the four edges of the reels 130, 131 in the direction of the axes may be used exclusively for the purpose of detecting the ink film.

Third Embodiment

Figure 16:
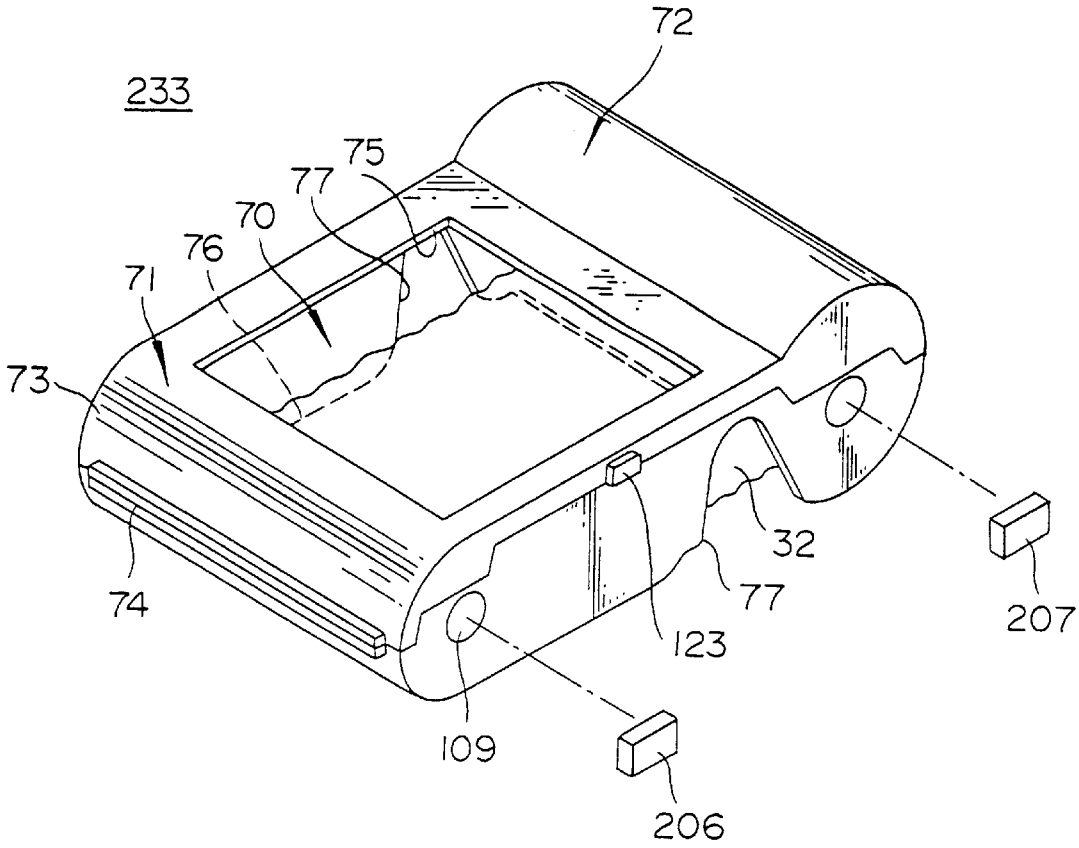
FIG. 16 is a perspective view illustrating schematically an ink film cassette according to the third embodiment, and sensors, which are disposed inside the thermal transfer recording apparatus and used for identifying a type of ink films.
Figure 17:
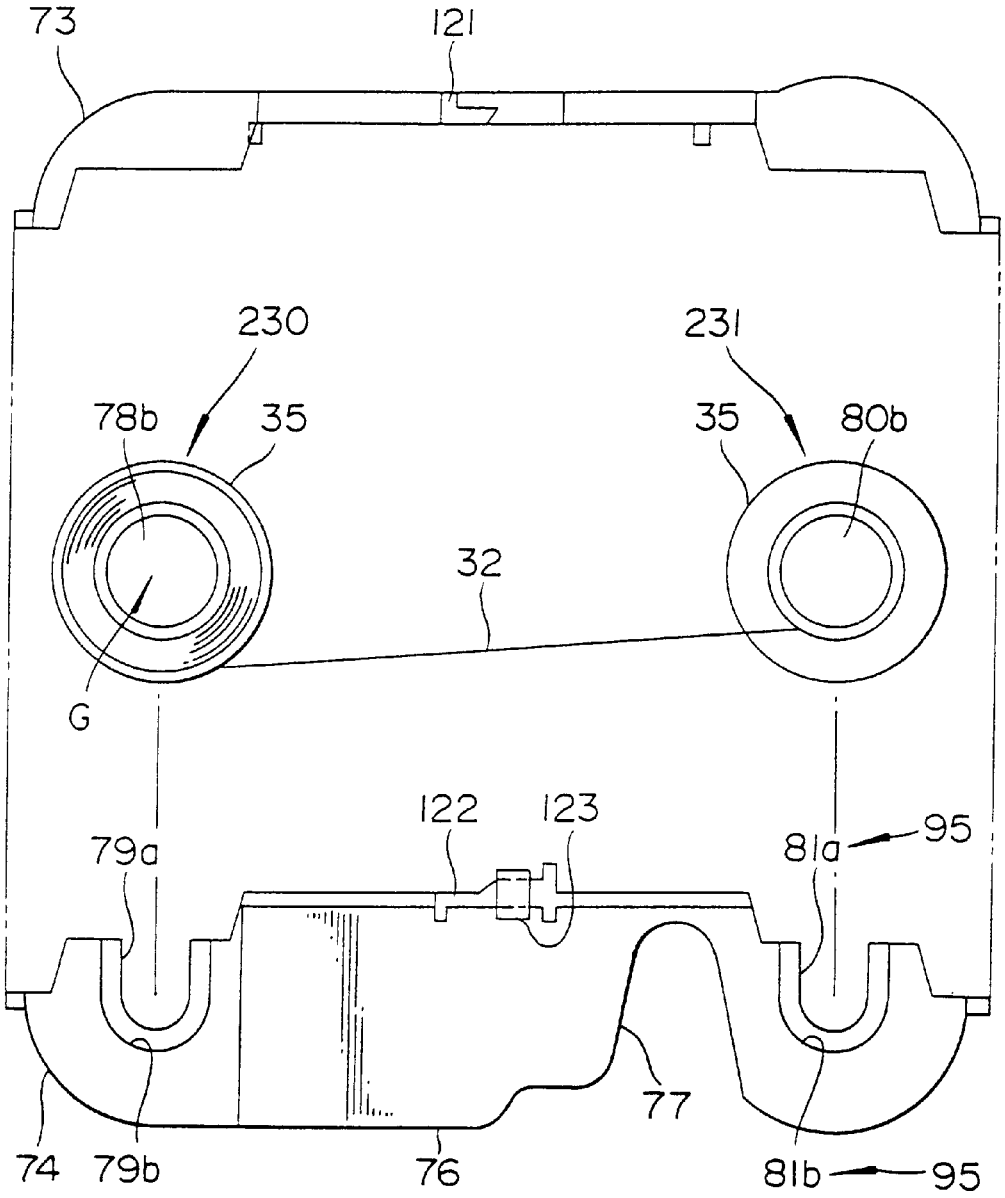
FIG. 17 is a side view illustrating the state in which the upper and the lower frame of the ink film cassette are opened and the ink film is detached.

FIG. 16 is a perspective view schematically illustrating an ink film cassette according to the third embodiment and sensors, which are used for identifying a type of ink film and disposed in the main body of the apparatus, and FIG. 17 is a side view illustrating the state in which the upper and the lower frame of the ink film cassette according to the third embodiment are opened and the ink film is removed. In these diagrams, like members described in the first embodiment are denoted by like reference numerals and are omitted from the description herein.

The third embodiment differs from the first and the second embodiments in respect that a reflecting sheet 109, which is as a target or subject of detection and corresponds to the specific type of ink film, is attached fast to either of the opposite edges of a supply reel 230 and/or a take-up reel 231, depending on the type of ink film. In the illustrated embodiment, the ref lecting sheet 109 is disposed on the cut surface of the shaft of the supply reel 230 as denoted by a symbol G in FIG. 17 and is not disposed on the cut surface of the shaft of the take-up reel 231. Photosensors 206, 207 as a detecting unit are disposed in the main body of the thermal transfer recording apparatus, corresponding to the positions of the axes of the reel 230 and 231. For example, a silver tape, which has a silver surface and produces a reflecting light detectable by the photosensors 206 and 207, may be used as the reflecting sheet 109. The reflecting sheet 109 does not need to be limited to the silver tape but may be formed of a substance, which is capable of sufficiently reflecting light.

The photosensor 206 detects the reflecting sheet 109 disposed on the supply reel 230 when an ink film cassette 233 is placed i n the main body of the apparatus. The photosensor 207 does not detect the reflecting sheet 109. The identification of the type of the ink film and the detection of the ink film can be done in advance of the printing operation by utilizing the result of the detection of the reflecting sheet 109 by the photosensors 206 and 207, similarly to the utilization of the result of the detection of the extension 110 of the reel in the first embodiment.

According to FIG. 16 and FIG. 17, the reflecting sheet 109 may be disposed in two places, i.e. one of the opposite edges of the supply reel 230 in the direction of its axis and one of the opposite edges of the take-up reel 231 in the direction of its axis. Optionally, the four positions, i.e. all the edges of the reels 230, 231 in the direction of their axes, may be used for the disposition of the reflecting sheet 109. Any one of the four edges of the reels 230, 231 in the direction of the axes may be used exclusively for the purpose of detecting the ink film.

Fourth Embodiment

Figure 18:
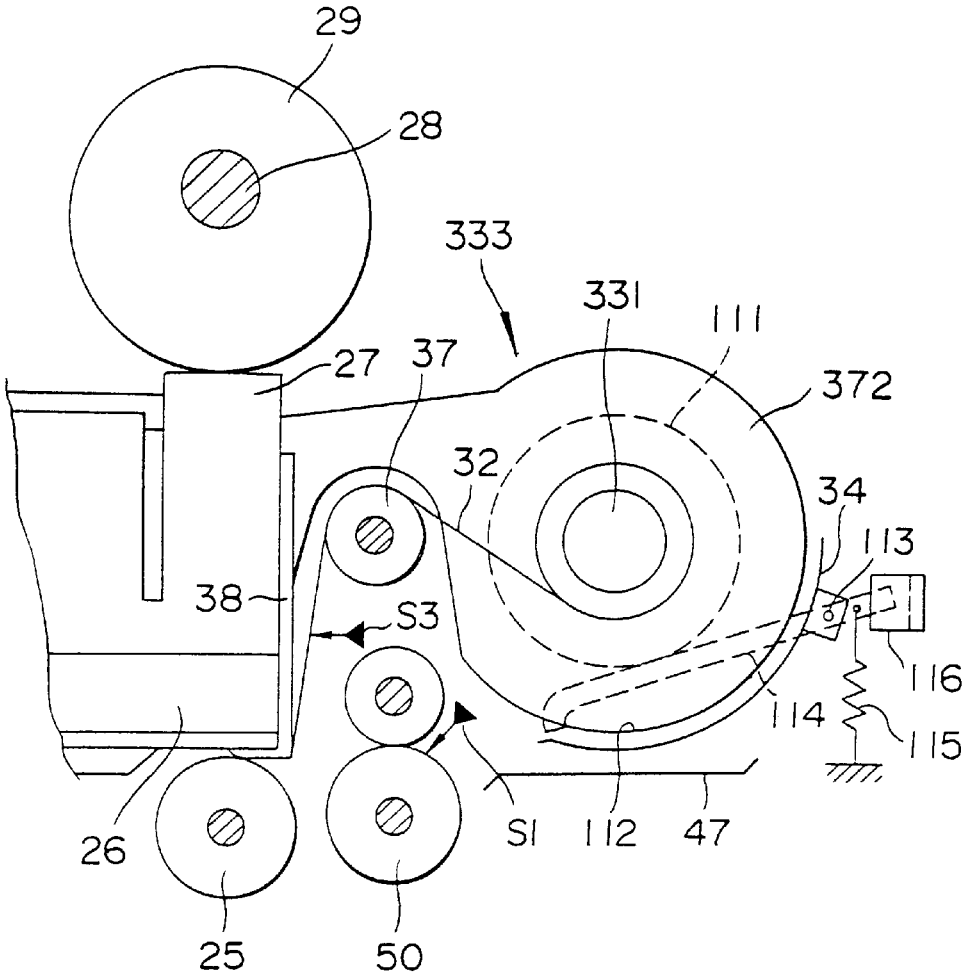
FIG. 18 and FIG. 19 are a partial side view and a partial plan view respectively illustrating a unit for detecting a reel through an opening formed in an ink film cassette according to the fourth embodiment'
Figure 19:
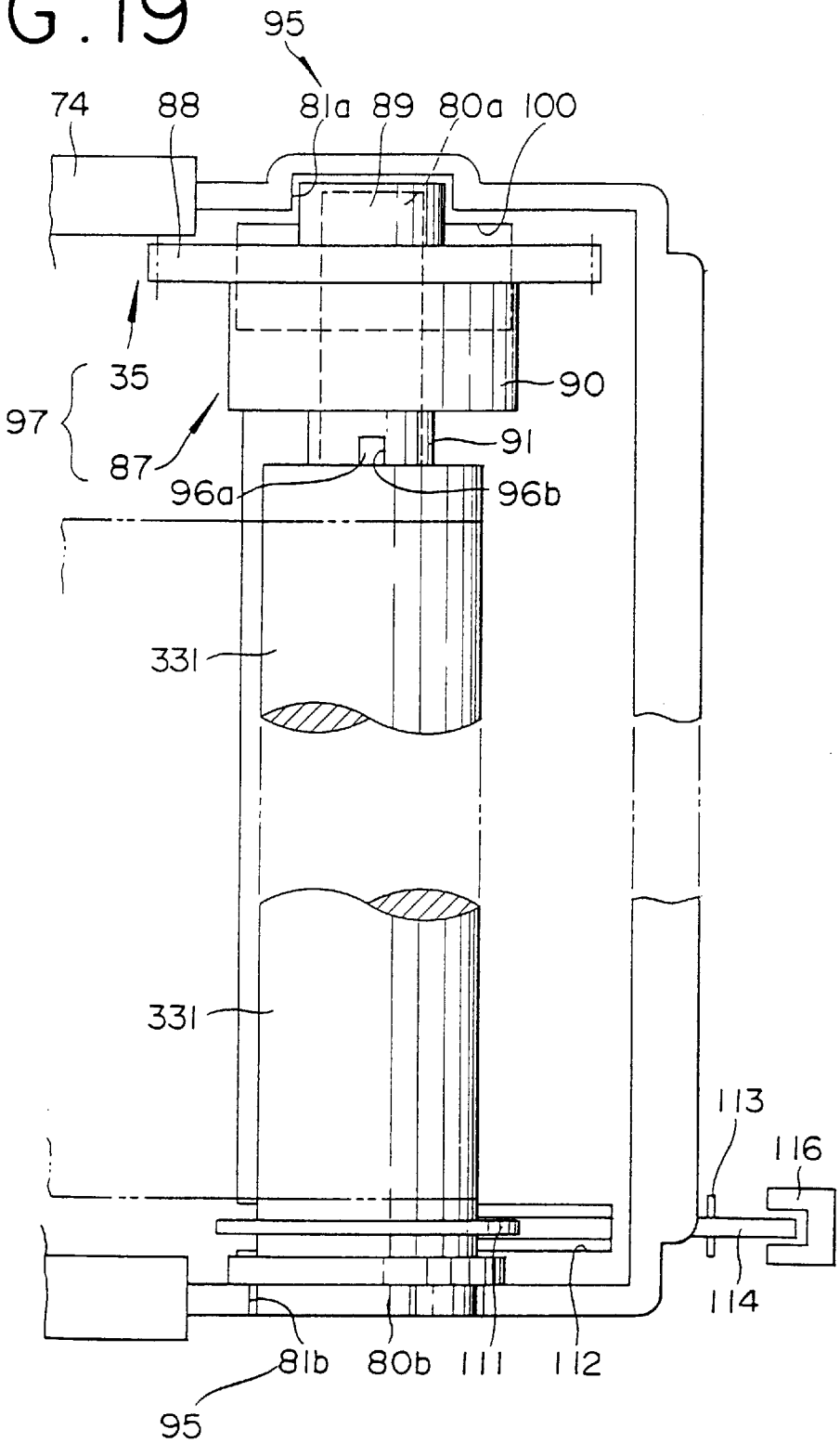

FIG. 18 is a partial side view illustrating a unit for detecting a reel through an opening formed in an ink film cassette and FIG. 19 is a partial plan view of the unit.

The fourth embodiment differs from the first through the third embodiment in respect that an unit for detecting an ink film is independently disposed in the main body of the thermal transfer recording apparatus, whereas the first through the third embodiment discern between the presence and the absence of an ink film by utilizing the result of the detection of the sensors 101, 102, etc. which identify a type of an ink film.

A flange 111 for detection is disposed near one of the edges of a take-up reel 331 as illustrated in the diagram. Part of the flange 111 confronts an opening 112, which is formed in the lower part of a take-up reel holder 372 of an ink film cassette 333. A lever 114 is so disposed in the main body of the thermal transfer recording apparatus as to rotate around a pin 113 as the center within a plane substantially perpendicular to the shaft of the reel. A spring 115 forces the lever 114 to rotate clockwise in the diagram and retreat to a position at which it is no longer detected by a photosensor 116 when the cassette is not mounted in the apparatus. The lever 114, the pin 113, the spring 115 and the photosensor 116 jointly compose a reel detecting unit.

One end of the lever 114 passes through the opening 112 and enters the cassette 333 when the cassette is mounted in operating position. The lever 114 is pressed by the flange 111 and rotated counterclockwise in the diagram in spite of the force of the spring 115. The photosensor 116 detects the lever 114 that has been rotated. Naturally, the photosensor 116 is in ON-state only when the ink film wound around the reel is present in the cassette 333 and not in ON-state when the ink film is missing in the cassette 333.

In FIG. 18, the photosensor 116 is so designed as to be in ON-state when the reel is present. It may be so planned as to be in ON-state when the reel is absent.

The fourth embodiment likewise enables the detection of an ink film to be simply and easily effected in advance of the printing operation by merely mounting the ink film cassette in operating position in the main body of the apparatus. The provision of the unit for detecting an ink film besides that of the sensors for identifying a type of ink film has the following advantage. For example, the unit according to the fourth embodiment is applied to the thermal transfer recording apparatus of the first embodiment which uses the cassette 33 illustrated in FIG. 5. It enables the detention of an ink film to be done even when the limit switches 101, 102 are both in the OFF-state, namely even when the reels R1 of ordinary length are used for both the supply reel 30 and the take-up reel 31. This fact means that the reels R1 of ordinary length can be used for both the supply reel 30 and the take-up reel 31 for the purpose of specifying a type of ink film besides the combination of the reels R1 and R2 which is illustrated in FIG. 11. In this case, the identification can be resultantly attained among four types of ink film.

Modification of Fourth Embodiment

Figure 20:
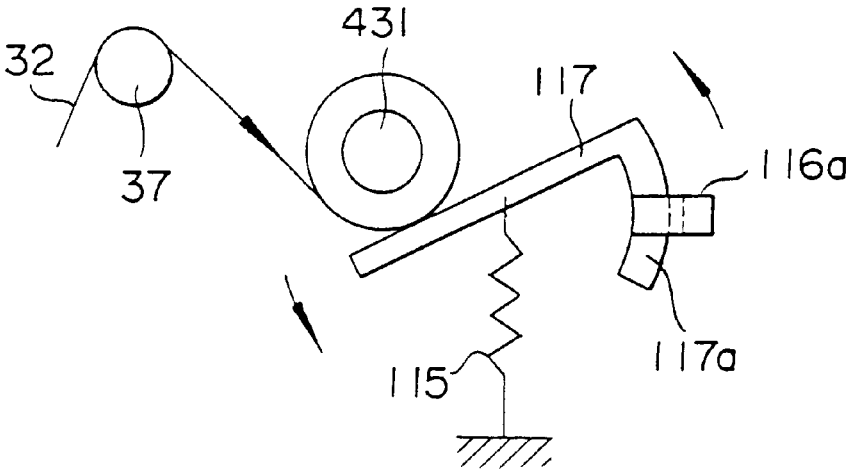
FIG. 20 is a partial side view illustrating a modification of the unit for detecting the reel through the opening formed in the ink film cassette.

FIG. 20 is a partial side view illustrating a modification of the unit for detecting the reel through the opening formed in the ink film cassette. According to this modification, a lever 117 is forced to directly come in contact with the surface of a take-up reel 431 for discerning between the presence and the absence of the ink film 32. For this reason, the modification does not require the flange 111 for detection. In this case, the take-up reel 431 grows in diameter with the wound ink film 32 as the printing operation advances. Thus, the lever 117 is gradually rotated in the direction of an arrow mark shown in the diagram. It is preferable to provide the lever 117 with such a bend 117*a* as is illustrated in the diagram, for the purpose of setting a photosensor 116*a* being in ON-state whenever the cassette is mounted in operating position, The method, which forces the lever to directly come in contact with the surface of the reel for detecting an ink film, results in making a scar on the ink film with contacting lever. The reel, which comes in contact with the lever 117, is preferably the take-up reel 431 on which the spent ink film is wound, as in the present modification. As a result, the reel has no adverse effect on an image formation.

However, the flange 111 may be disposed near either of the edges of the supply reel 30 when the method that the lever 114 comes in contact with such a member as the flange 111 is applied for detection for detecting an ink filter. This is because it has no possibility of touching and scratching the ink film 32.

The embodiments described above are not meant to define the scope of this invention but may be variously modified. For example, the above embodiments are so designed as to dispose the torque limiters inside the ink film cassette. This invention does not preclude the application such that the supply side torque limiters and the take-up side torque limiters are disposed not inside a cassette but inside the main body of the recording apparatus instead.

Fifth Embodiment

For the replacement of a spent ink film with a new supply, the following two methods are conceivable. One as the method (1) is composed of detaching torque limiters jointly with reels from inside a cassette, detaching the torque limiters from the reels, attaching the torque limiters to newly supplied reels, and mounting the torque limiters and the reels in a joined state to the cassette. The other as the method (2) is composed of removing only reels from a cassette to which torque limiters are integrally attached, and mounting newly supplied reels to the cassette.

The present inventors have pursued a diligent study in due respect of the methods of replacement of the ink film. And the present inventors find that the method (2) is capable of preventing possible missing of torque limiters and preventing possible erroneous mounting of the torque limiters. As a result, the present invention has been perfected. In the case of the method (2), it is important how to make and break the connection between the torque limiters and the reels inside the cassette. In addition, it is necessary to facilitate the attachment and the detachment of the reels with preventing the cassette from unduly growing in dimension due to the set-in torque limiters. Now, the fifth embodiment will be described in detail below.

<<General Arrangement of Ink Film Cassette>>

Figure 21:
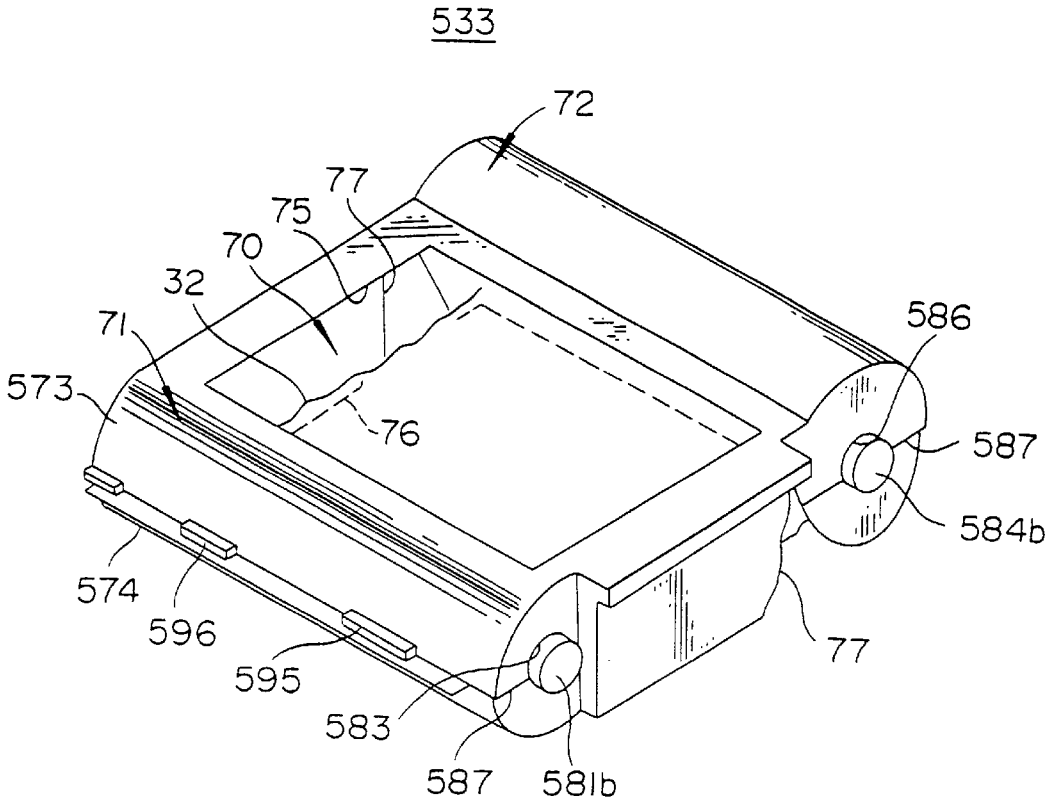
FIG. 21 is a perspective view illustrating the outside appearance of an ink film cassette according to the fifth embodiment.
Figure 22:
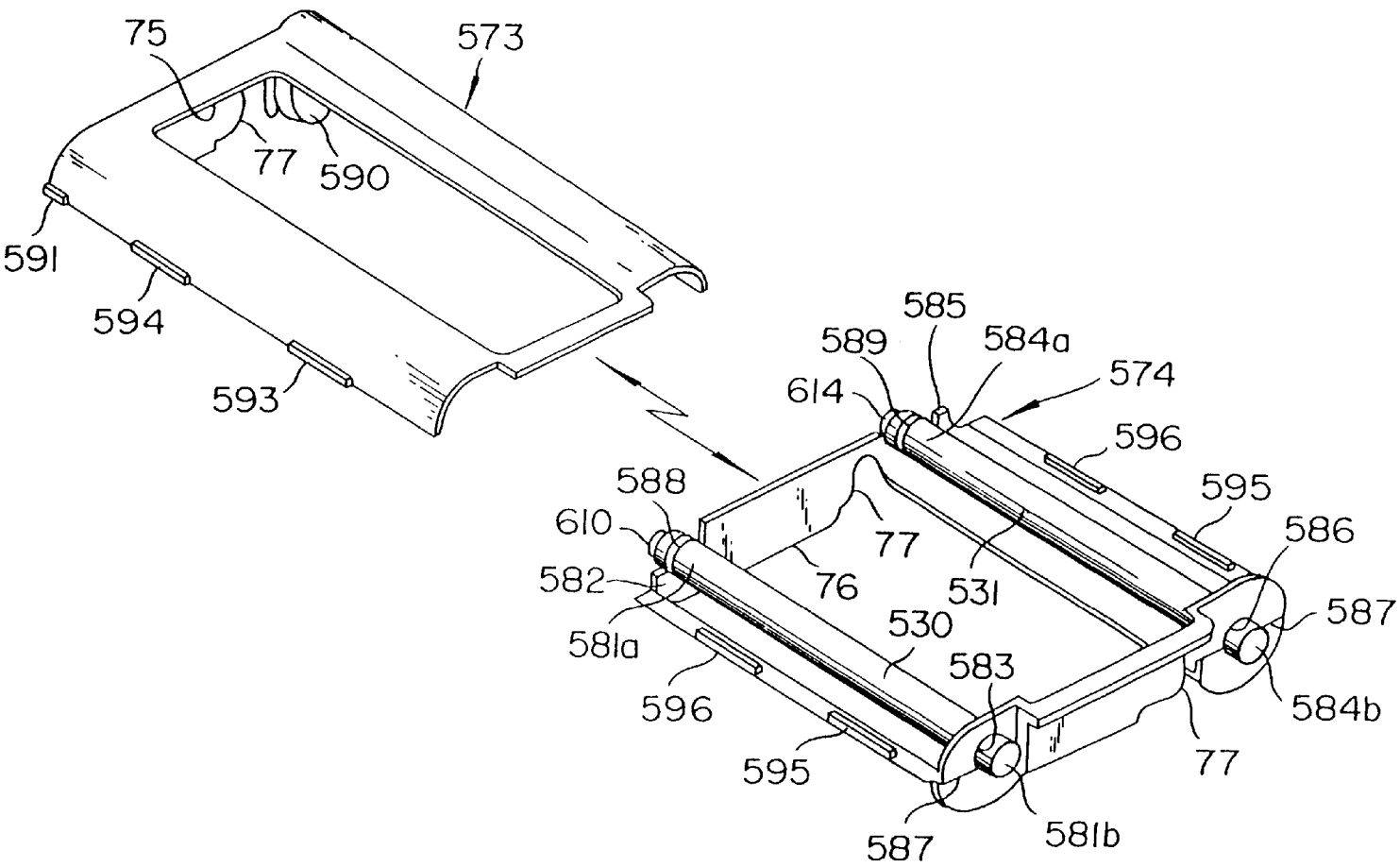
FIG. 22 is a perspective view illustrating the state in which the lower frame and the upper frame of the ink film cassette are removed by being slid relative to each other along the direction of the axial line of the reel.
Figure 23:
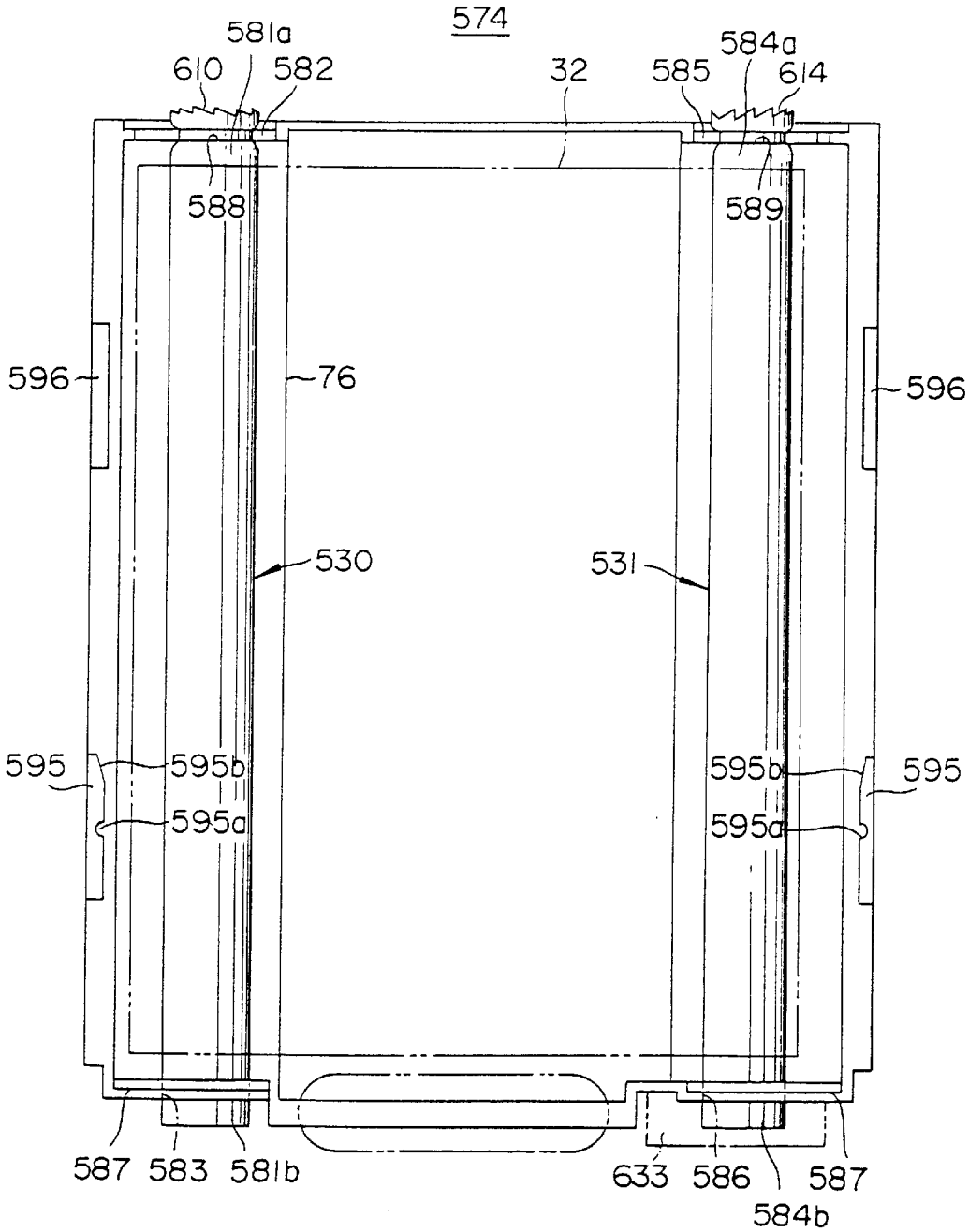
FIG. 23 is a plan view illustrating the lower frame supporting a supply reel and a take-up reel.
Figure 24:
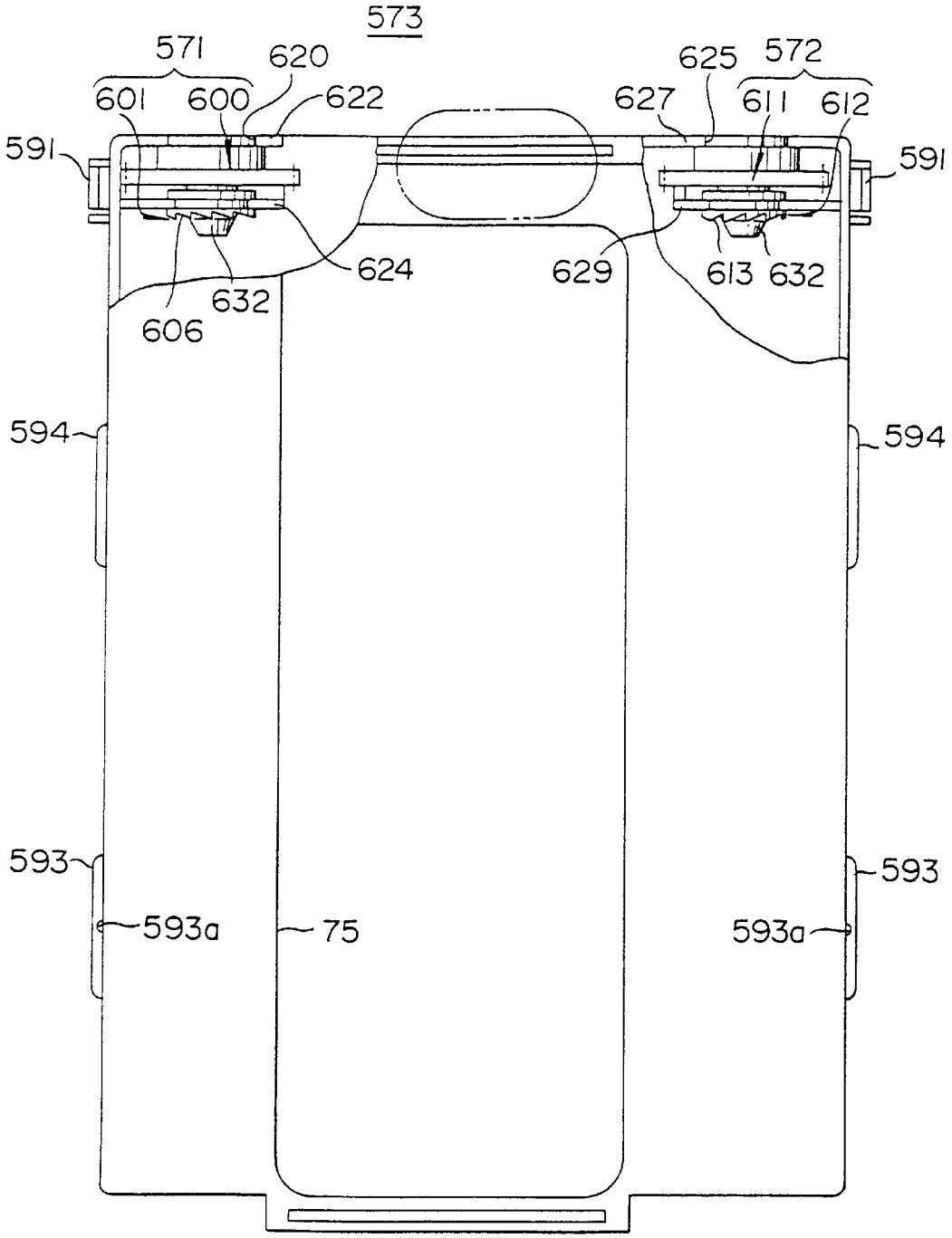
FIG. 24 is a partially cutaway plan view illustrating the upper frame holding a first torque limiter connected to the supply reel and a second torque limiter connected to the take-up reel.
Figures 25A, 25B, 25C:
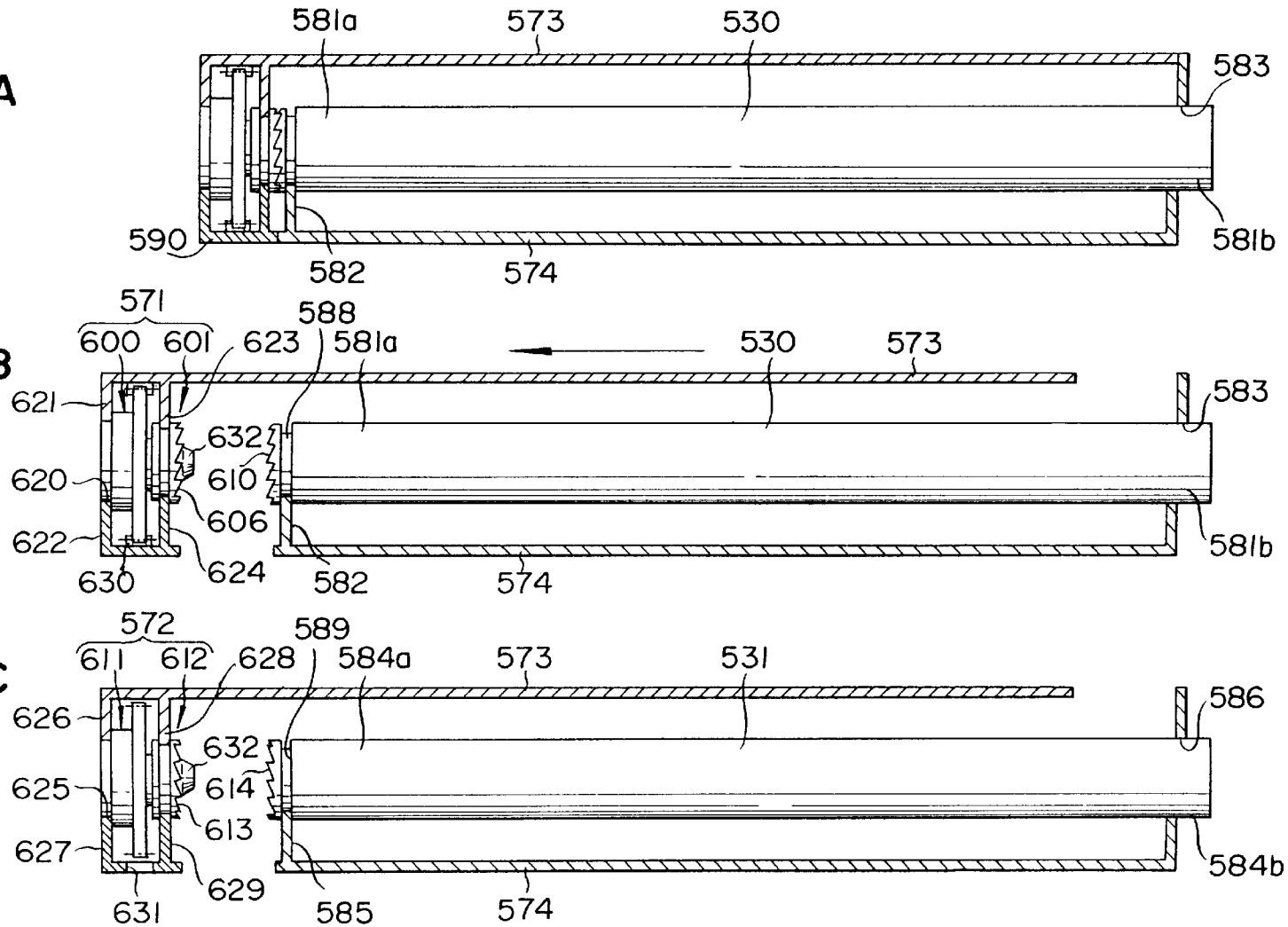
FIG. 25A is a cross section illustrating the state in which the upper and the lower frame are set in place as viewed on the supply reel side, FIG. 25B a cross section illustrating the state in which the upper frame is slightly slid relative to the lower frame as viewed from the supply reel side.
FIG. 25C is a cross section illustrating the state in which the upper frame is slightly slid relative to the lower frame as viewed from the take-up reel side.

FIG. 21 is a perspective view illustrating the outside appearance of an ink film cassette according to the fifth embodiment, FIG. 22 is a perspective view illustrating the state in which the lower frame and the upper frame of the cassette are removed by being slid relatively along the direction of the axial line and removed, FIG. 23 is a plan view illustrating the lower frame holding the supply reel and the take-up reel, FIG. 24 is a partially cutaway plan view illustrating the upper frame holding a first torque limiter connected to the supply reel and a second torque limiter connected to the take-up reel, FIG. 25A is a cross section illustrating the state in which the upper and the lower frame are set in place as viewed on the supply reel side, FIG. 25B is a cross section illustrating the state in which the upper frame is slightly slid relative to the lower frame as viewed from the supply reel side, and FIG. 25C is a cross section illustrating the state in which the upper frame is slightly slid relative to the lower frame as viewed from the take-up reel side. FIGS. 26A-26E are diagrams illustrating an artist's concept of the procedure of replacing an ink film.

As illustrated in FIG. 21, FIG. 23, and FIG. 24, an ink film cassette 533 is provided with a supply reel 530 wound with an ink film 32, a take-up reel 531 which is wound with the ink film 32 paid out of the supply reel 530, a first torque limiter 571 which gives braking force to the shaft of the supply reel 530 in the cassette, a second torque limiter 572 which limits the drive torque of the take-up reel 531 in the cassette, a first frame which supports the supply reel 530 and the take-up reel 531, and a second frame which supports the first and second torque limiters 571, 572 and is detachable from the first frame. In the fifth embodiment, the first frame is a lower frame 574 and the second frame is an upper frame 573. As illustrated in FIG. 22 and FIGS. 25A–25C, the lower frame 574 and the upper frame 573 are so designed as to be detachable by being slid relatively along the direction of the axial lines of the reels 530, 531.

Figure 26A:
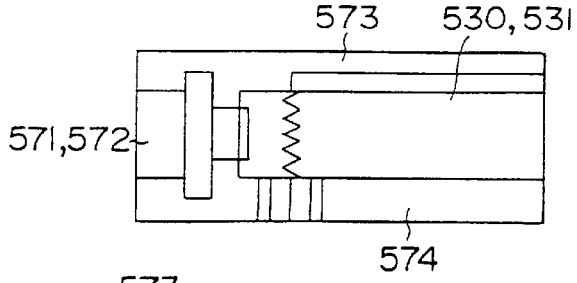
FIGS. 26A–26E are diagrams illustrating an artist's concept of the procedure of replacing an ink film.
Figure 26B:
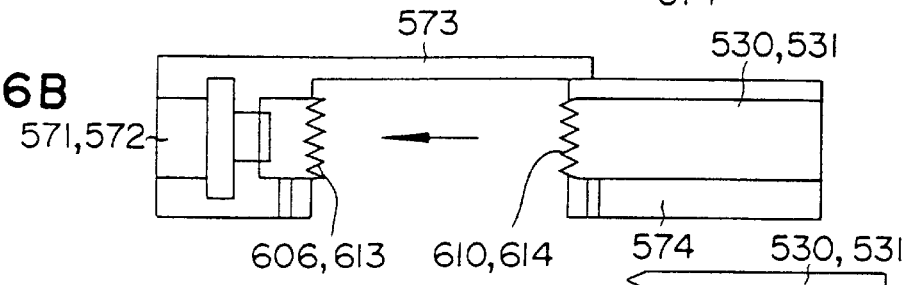
Figure 26C:
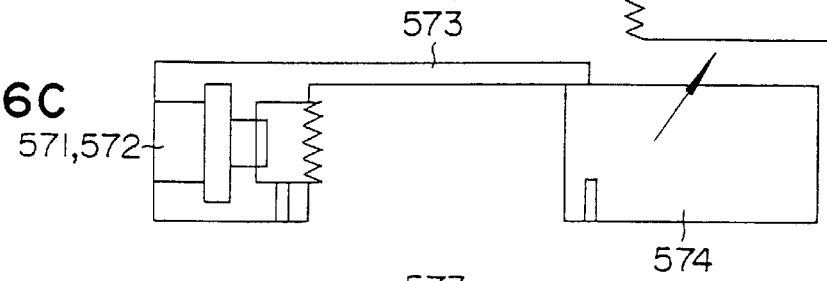
Figure 26D:
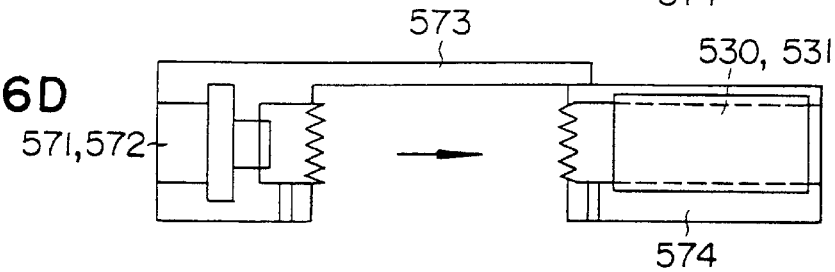
Figure 26E:
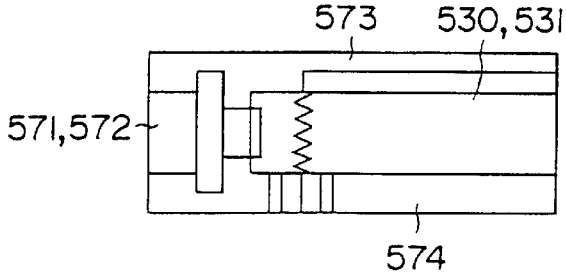

The procedure for the replacement of the ink film will be briefly explained with reference to FIGS. 26A–26E. When the ink film 32 has been used up (FIG. 26A), the upper frame 573 is opened by being slid in the direction indicated by an arrow mark (FIG. 26B). The spent supply reel 530 and the take-up reel 531 are removed from the lower frame 574 (FIG. 26C). Then, newly supplied reels 530, 531 are inserted in the lower frame 574 (FIG. 26D). And the upper frame 573 is closed by being slid in the direction indicated by an arrow mark for completing the replacement of the ink film (FIG. 26E). The ink film is replaced by this simple procedure.

The upper frame 573 continuously holds the two torque limiters 571, 572 while the replacing work is in process. It results in essentially eliminating the possibility of losing the torque limiters 571 and 572, or confusing the torque limiter 571 on the supply side with the torque limiter 572 on the take-up side and erroneously mounting them in operating position in the replacement of the ink film which comprises the series of operations.

Further, the sliding motion of the upper frame 573 makes or breaks the connection between the first torque limiter 571 and the supply reel 530, and the connection between the second torque limiter 572 and the take-up reel 530. The user, therefore, is not required to be conscious of aligning the edges of the torque limiters with the edges of the reels 530, 531.

The fifth embodiment adopts, for the replacement of the ink film, a method which comprises removing only the reels 530, 531 from the cassette 533 integrally holding the torque limiters 571 and 572, and mounting newly supplied reels 530, 531 in the cassette 533. As to such a procedure of replacement, it is important how to make and break the connection between the torque limiters 571, 572 and the reels 530, 531 inside the cassette 533. Incidentally, it is necessary to facilitate the attachment and the detachment of the reels 530, 531 and prevent the cassette 533 from unduly growing in dimension due to the set-in torque limiters 571, 572. And, it is necessary to avoid lowering the dimensional accuracy with which the reels 530, 531 are held. For the purpose of satisfying these requirements, the components of the ink film cassette 533 are designed as described in detail below.

<<Lower Frame>>

The supply reel 530 and the take-up reel 531 are set in the lower frame 574, as illustrated in FIG. 23 and FIGS. 25A–25C. A holding plate 582, which is projected upright from the bottom wall of the lower frame 574, keeps the edge 581*a* that is shown on the upper side in FIG. 23, as one of the opposite edges 581*a*, 581*b* of the shaft of the supply reel 530. The holding plate 582 has a semicircular recess. The other edge 581*b* is supported as rotatably inserted in a mounting hole 583 formed in the lateral wall of the lower frame 574. By the same token, a holding plate 585 with a recess keeps one of the edges 584*a* of the shaft of the supply reel 531, and the other edge 584*b* is supported as rotatably inserted in a mounting hole 586 formed in the lateral wall of the lower frame 574.

The edges 581*b*, 584*b* of the reels 530, 531 are slightly extended outward from the lower frame 574. As explained in the first through the third embodiment, a size of the extension or the information carried by the seal attached to the extension is detected for identifying a type of a stored ink film 32.

As clearly shown in FIG. 21 and FIG. 22, the lateral wall of the lower frame 574 has a difference 587 in level. As a result, as to the mounting holes 583 and 586 on the supply side and the take-up side, the upper half part is slightly displaced outward from the lower half parts along the axial lines of the reels 530, 531, as illustrated in FIGS. 25A–25C.

Figure 27A:
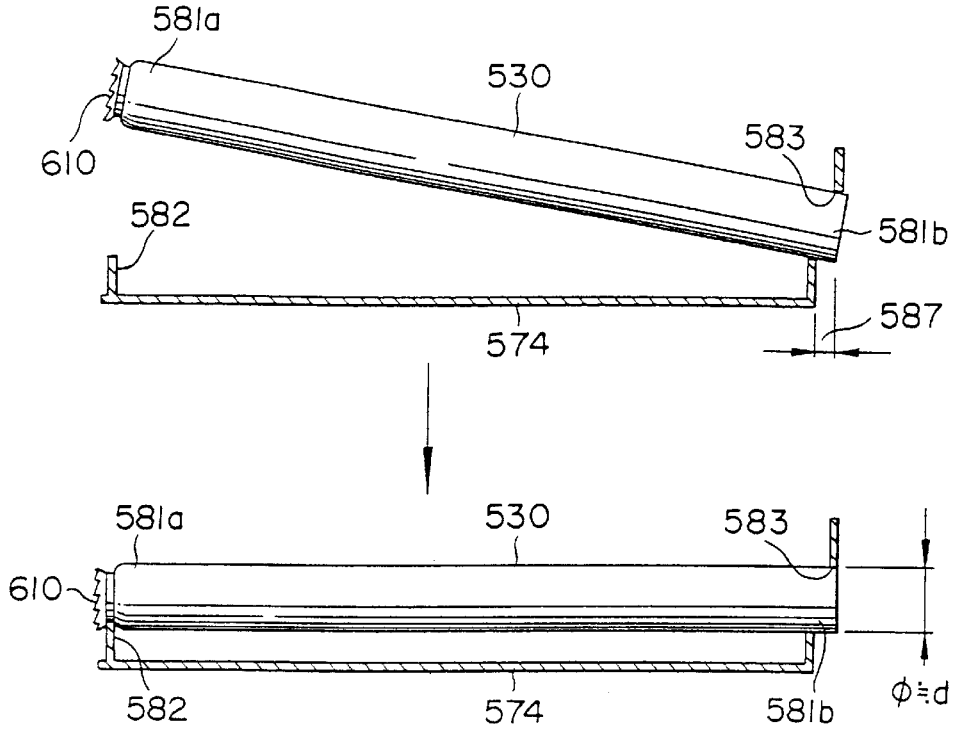
FIG. 27A and FIG. 27B are cross sections illustrating the state in which the supply reel is mounted to the lower frame.
Figure 27B:
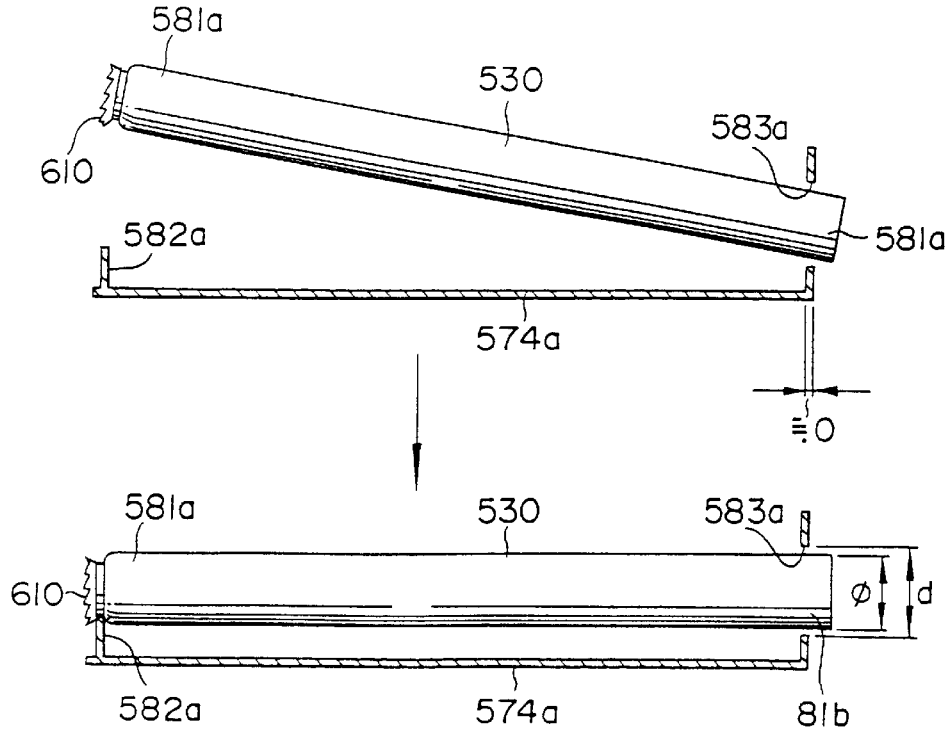

FIG. 27A and FIG. 27B are cross sections illustrating the state in which the supply reel is mounted to the lower frame; FIG. 27A depicting the fifth embodiment and FIG. 27B depicting a comparative case. In the comparative case in which a mounting hole 583*a* is formed on the lateral wall of the lower frame 574*a* with no difference in level as illustrated in FIG. 27B, a clearance or difference between the hole diameter d and the reel shaft diameter $\phi$ is increased when the supply reel 530 is mounted. The increase of the clearance causes the reel 530 to jolt and such adverse phenomena as wrinkling and binding. Namely, the increase of the clearance is not desirable from the standpoint of producing an image of high quality.

In contrast, in the case of the fifth embodiment in which the lateral wall of the lower frame 574 has a difference 587 in level as illustrated in FIG. 27A, the clearance, which is the difference between the hole diameter d and the reel shaft diameter $\phi$ when the supply reel 530 is mounted, is small as compared with that in the comparative case. It results in reducing the play or the jolt of the supply reel 530, and improving the accuracy of the hole diameter necessary for the acquisition of an image of high quality. The supply reel 530 is obliquely inserted into the mounting hole 583. Thus, the fact that the hole diameter d is small does not impair the ease of the mounting. The formation of the mounting hole 583 with the difference 587 makes it possible to achieve ease and accuracy concerning the mounting of the supply reel 530. Incidentally, the mounting hole 586 on the take-up side has a similar difference 587 so as to achive ease and the accuracy concerning the mounting of the take-up reel 531.

The positioning of the reels 530, 531 in the direction of the axis is attained by engaging annular grooves 588, 589 formed in the reels 530, 531 with the recesses of the holding plates 582, 585 of the lower frame. And the positioning of the ink film 34 in the direction of the axis is simultaneously accomplished relative to the lower frame 574.

<<Upper Frame>>

Figure 28:
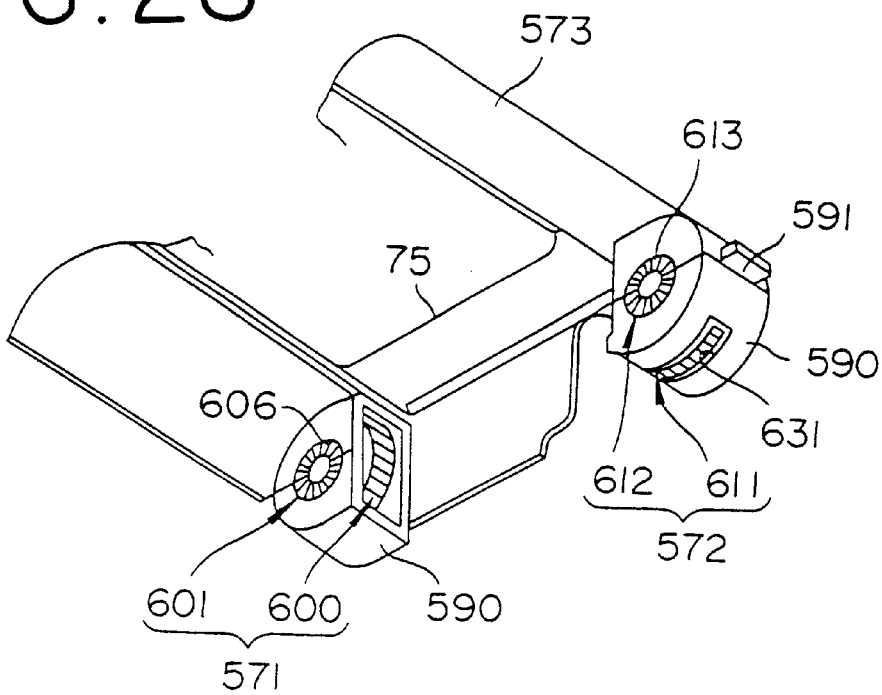
FIG. 28 is a perspective view illustrating the essential part of the upper frame as viewed upward from the lower surface side.

FIG. 28 is a perspective view illustrating the state of the essential part of the upper frame as viewed upward from the lower surface side. A cover 590, which holds the first and second torque limiters 571, 572 jointly with the upper frame 573, is mounted to the lower surface side of the lateral edge of the upper frame 573. This cover 590, which is integrally composed of a portion for holding the first torque limiter 571 and a portion for holding the second torque limiter 571, is held in place as engaged with an engaging piece 591 of the upper frame 573. The upper frame 573 holds the first and second torque limiters 571, 572 as nipped between the upper frame 573 and the cover 590.

Figure 29:
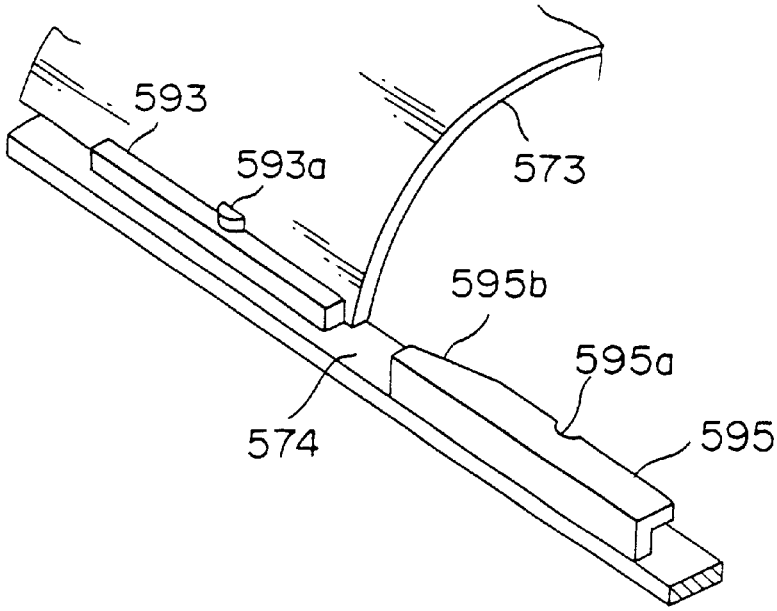
FIG. 29 is a perspective view illustrating a sliding mechanism for the upper and the lower frame.

FIG. 29 is a perspective view illustrating a sliding mechanism for the upper and the lower frame. A first and a second slide 593 and 594 are disposed in the lateral edges of the upper frame 573 as illustrated in FIG. 24 and FIG. 29. Meanwhile, first and second holding members 595 and 596 for holding the first and second slides 593 and 594 are mounted to the lateral edges of the lower frame 574 as illustrated in FIG. 23 and FIG. 29. The slides 593, 594 each have a rectangular cross section. The holding members 595, 596 each have a cross section like a letter L that is suitable for accepting the slides 593, 594. The first slide 593 has a protrusion 593*a*. The first holding component 595 has a recess 595*a* coincidingwith the protrusion 593*a*. As a result, the upper and lower frames 573 and 574 are prevented from producing an accidental sliding motion. An inclined plane 595*b* is formed in the first holding component 595. The first slide 593 is inserted as guided by the inclined plane 595*b*.

As a result of the engagement of the slides 593, 594 with the holding components 595, 596, the upper and lower frames 573 and 574 are fixed mutually. If the upper and lower frames 573 and 574 are suddenly detached while these frames 573, 574 are being removed from the mutually fixed state, the user will suddenly come to feel the weight of the reels 530, 531 mounted on the lower frame 574, and acquire the sense as though his arm were twisted. To preclude this accident, the locations and the dimensions of the slides 593, 594 and the holding components 595, 596 are designed such that the first and second slides 593 and 594 are not simultaneously detached from the respective holding components 595, 596 but the second slide 594 is divided earlier from the second holding component 596 than the first slide 593. This deliberate arrangement allows the user to prepare himself unconsciously for the "oncoming displacement" and reduces the sensation of weight exerted on the user.

<<Arrangement of Torque Limiter and Engagement Arrangement of Torque Limiter and Reel>>

Figures 30A, 30B:
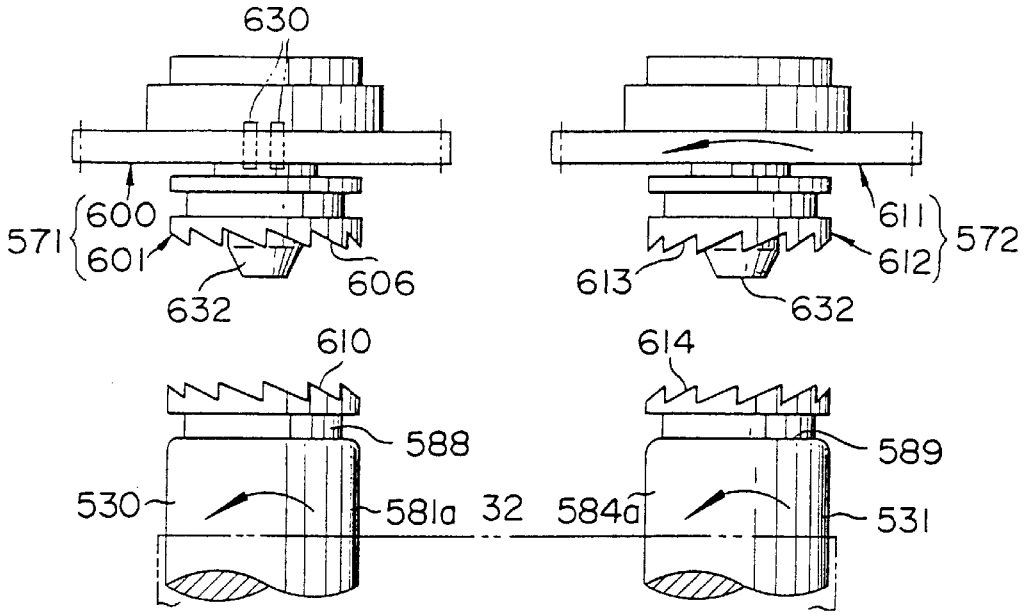
FIG. 30A is a enlarged detail illustrating a supply reel and a first torque limiter and FIG. 30B a enlarged detail illustrating a take-up reel and a second torque limiter.
Figure 31:
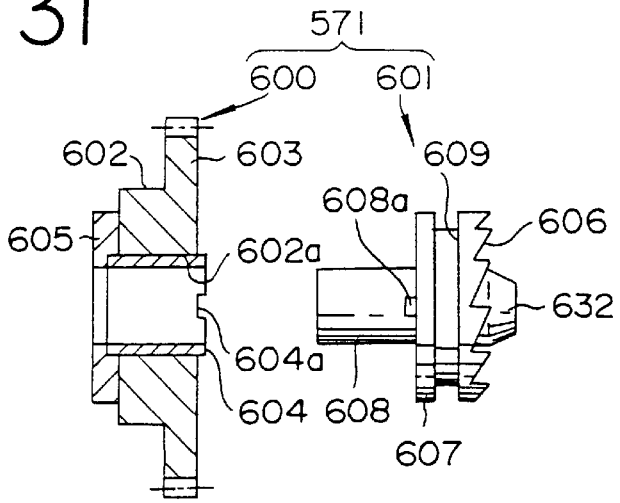
FIG. 31 is a diagram illustrating a gear and a ratchet unit which jointly form the first torque limiter, with gears depicted in a cross section.

FIG. 30A is a enlarged detail illustrating a supply reel and a first torque limiter, FIG. 30B is a enlarged detail illustrating a take-up reel and a second torque limiter, and FIG. 31 is a diagram illustrating a gear and a ratchet unit which compose the first torque limiter, with the gear depicted in cross section.

The first torque limiter 571, as illustrated in FIG. 30A and FIG. 31, comprises a gear 600 with the function of a limiter and a ratchet unit 601 set in the gear 600. The gear 600 comprises a shaft 602, a disc 603 which is formed integrally with the shaft 602 and provided on the outer surface with teeth, an inner shaft 604 which is rotatably inserted through a through hole 602*a* formed in the shaft 602, and a stopper 605 which limits the motion of the inner shaft 604 in the direction of axis. The inner shaft 604 generates the torque of friction with the through hole 602*a* and bears the load of rotation. Optionally, the resilient force of a spring may be utilized for exerting the load of rotation on the inner shaft. In this case, the resilient force of the spring is preferably adjusted freely with such means as a set-screw. The ratchet unit 601 comprises a head 607 with a ratchet 606 and a shaft 608 inserted in the inner shaft 604 of the gear 600. The ratchet unit 601 is mounted to the gear 600 owing to the engagement of a protrusion 608*a* formed in the shaft 608 and a recess 604*a* formed in the inner shaft 604. The ratchet unit 601 is rotated in concert with the inner shaft 604. An annular groove 609 is formed on the periphery of the head 607 of the ratchet unit 601. A ratchet 610, which is engaged with the ratchet 606 of the ratchet unit 601, is formed in the edge 581*a* of the supply reel 530. Owing to the engagement of the ratchet 610 of the supply reel 530 and the ratchet 606 of the ratchet unit 601, the supply reel 530 and the inner shaft 604 of the first torque limiter 571 are rotated together as one.

The second torque limiter 572 comprises a gear 611 with the function of a limiter and a ratchet unit 612 mounted to the gear 611, similarly to the first torque limiter 571. A ratchet 614, which is engaged with a ratchet 613 of the ratchet unit 612, is formed in the edge 584*a* of the take-up reel 531. Owing to the engagement of the ratchet 614 of the take-up reel 531 and the two ratchets 613 of the ratchet unit 612, the take-up reel 531 and the inner shaft 604 of the second torque limiter 572 are rotated together as one. However, the ratchets 606 of the ratchet units 601 for use with the first torque limiter 571 is directed opposite to the ratchets 613 of the ratchet units 612 for use with the second torque limiter 572 as clearly noted from FIG. 30A and FIG. 30B. As a natural consequence, the ratchet 614 of the take-up reel 531 is directed opposite to the ratchet 610 of the supply reel 530.

It is preferable that the torque limiters 571, 572 are composed of the components made of the same material and simply different in terms of a set value of torque. In consequence of this arrangement, the difference of torque on the supply side and the take-up side can be easily held. Because the two torque limiters 571, 572 exhibit identical behaviors even when the working temperature of the ink film cassette 533 is varied. Incidentally, the components on the supply side and the components on the take-up side may be formed of different substances when the variation in the difference of torque can be restrained within an acceptable range.

Holding walls 621 and 622, which define a through hole 620 that passes the stopper 605 of the gear 600, and holding plates 623 and 624, which engage the annular groove 609 of the ratchet unit 601, are formed on the supply sides of the upper frame 573 and the cover 590, as illustrated in FIG. 25B. Holding walls 626 and 627, which define a through hole 625 that passes the stopper 605 of the gear 611, and holding plates 628 and 629, which engage the annular groove 609 of the ratchet unit 612 are formed on the take-up sides of the upper frame 573 and the cover 590, as illustrated in FIG. 25C. Semicircular recesses are respectively formed on the holding walls 621, 622, 626 and 627, and the holding plates 623, 624, 628 and 629. The holding plates 623, 624, 628 and 629 are engaged with the annular grooves 609 of the ratchet units 601, 612 when the cover 590 is mounted to the upper frame 573. As a result, the ratchet units 601, 612 and the gears 600, 611 do not fall off and the torque limiters 571, 572 are continuously held by the upper frame 573 even when the upper frame 573 is removed from the lower frame 574.

Figure 32:
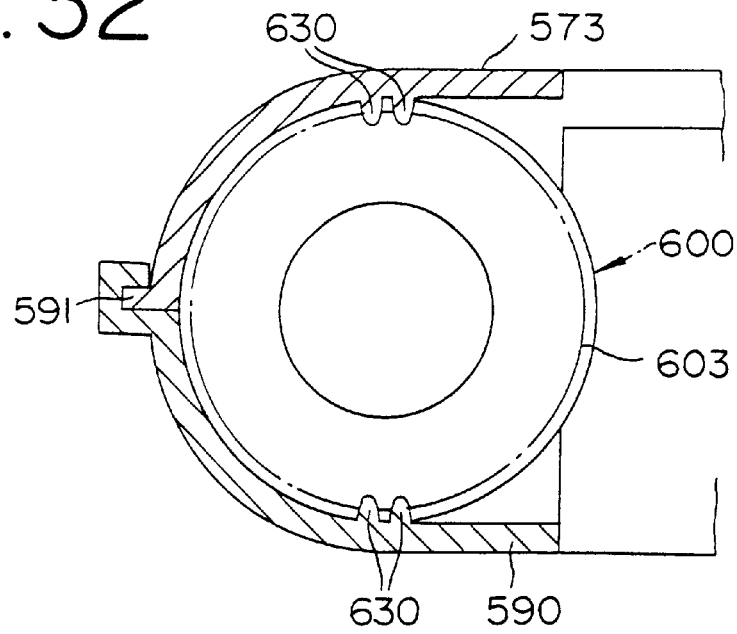
FIG. 32 is a cross section illustrating the arrangement in which the first torque limiter is mounted so as to produce no rotation relative to the upper frame.

The first torque limiter 571 on the supply side is designed to give back tension to the supply reel 530 for preventing the supply reel 530 from easily rotating. The first torque limiter 571 is fixed in a nonrotatable state relative to the upper frame 573. Specifically, the first torque limiter 571 is fixed to and held by the upper frame 573 owing to the fact that the gear 600 is nipped between the upper frame 573 and the cover 590 as illustrated in FIG. 32. Incidentally, protrusions 630, which correspond to the teeth of the gear 600, are formed on the inner faces of the upper frame 573 and the cover 590. The engagement of the protrusions 630 and the teeth of the gear 600 are utilized for preventing the gear 600 from rotating. In the state, the torque of friction acts on the inner shaft 604 and also on the supply reel 530 connected to the inner shaft 604 through of the ratchets 606, 610. For that reason, the supply reel 530 is not rotated unless a torque resisting the torque of friction acts on the supply reel 530. In brief, the first torque limiter 571 gives a braking force to the shaft of the supply reel 530 and a load of rotation on the supply reel 530 inside the cassette 533.

The present embodiment has the protrusions 630 provided for both the upper frame 573 and the cover 590 as depicted above. It, however, suffices to have the protrusions 630 provided for at least either of the upper frame 573 and the cover 590. The disc 603 does not need to have the teeth when the first torque limiter 571 can be mounted in a nonrotatable state relative to the upper frame 573. Incidentally, the gear 611 forming the second torque limiter 572 maybe diverted so long as the protrusions 630 are provided. The provision of the protrusions 630 is preferable for standardizing the components of the torque limiters 571, 572 and reducing the cost of components.

The second torque limiter 572 is mounted in a freely rotatable state relative to the upper frame 573. The gear 611 of the second torque limiter 572 is disposed so as to confront an opening 631 formed in the cover 590 (FIG. 25C and FIG. 28). The gear 611 is engaged through the opening 631 with the drive gear 36 for winding an ink film when the cassette 533 is mounted in the main body of the apparatus. The driving force of the drive gear 36 is transmitted via the second torque limiter 572 to the take-up reel 531 and then the ink film 32. The rotating force of the gear 611 is not transmitted to the take-up reel 531 and the gear 611 is alone rotated idly when a driving torque greater than the torque of friction acting on the inner shaft 604 acts on the gear 611. In this manner, the second torque limiter 572 limits the driving torque of the take-up reel 531 inside the cassette 533.

Figure 33A:
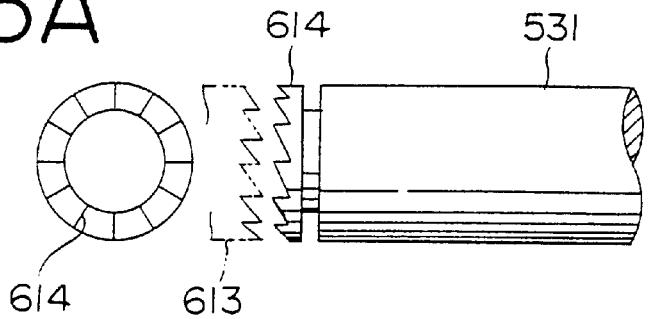
FIG. 33A and FIG. 33B are diagrams illustrating various shapes of ratchets formed in the edge of a reel, each diagram depicting a front view and a side view.
Figure 33B:
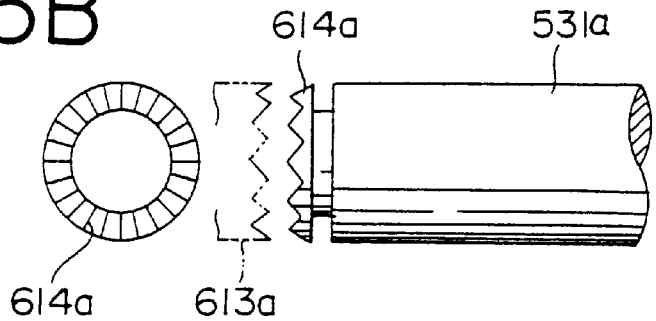

FIG. 33A and FIG. 33B are a front view and a side view, illustrating various shapes of ratchets that are formable in the edges of reels. They illustrate the shapes of ratchets with respect to the supply reel, by way of example.

The ratchet 614 with the shape as illustrated in FIG. 33A does not suffer the load exerted in the direction of thrust during the rotation of the reel. The ratchet 614 with this tooth form tends to come in contact with the ratchet 613 of the second torque limiter 572 shown by an imaginary line. However, it produces no practical hindrance because it absorbs this contact of teeth once it starts rotating. The ratchet 614*a* with the shape as illustrated in FIG. 33B suffers the load of thrust while the reel is in rotation. The ratchet 614*a* with this tooth form has difficulty in coming in contact with the ratchet 613*a* on the torque limiter side shown by an imaginary line. Thus, the edges of the torque limiter and the reel 531*a* tend to engage each other. This shape of ratchet, however, disperses force and impairs the uniformity of the tension exerted on the ink film as compared with the shape of ratchet shown in FIG. 33A. For this reason, the shape of ratchet illustrated in FIG. 33A is applied to the reels 530, 531 of the fifth embodiment. As described later, the reels 530, 531 with this shape of ratchet do not require the positioning in case of the mount. The mounting of the reels 530, 531 is easy. And the engagement of the reels 530, 531 and the torque limiters 571, 572 is easy as well.

Figure 34A:
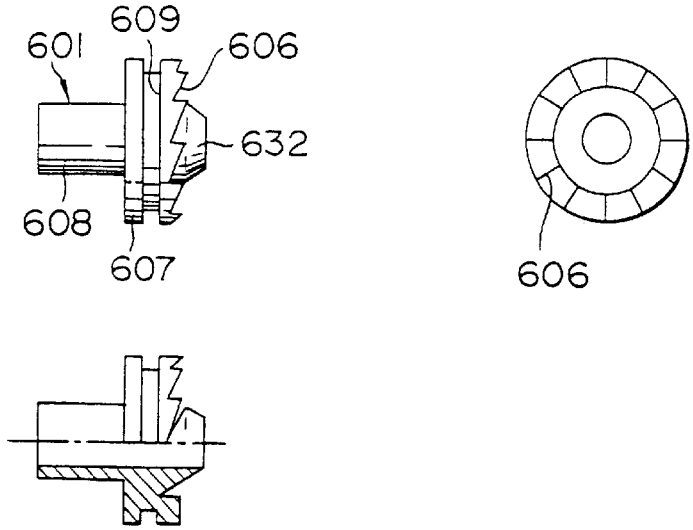
FIGS. 34A–34C are diagrams illustrating various shapes of ratchets formed in the ratchet unit of the torque limiter, each diagram depicting a front view, a side view, and a half-sectioned view.
Figure 34B:
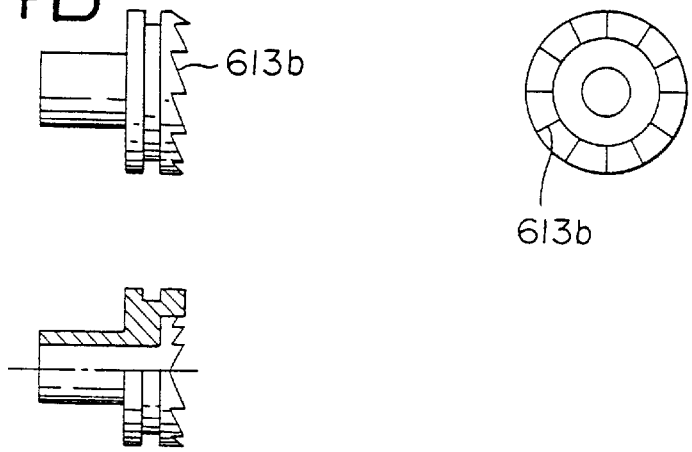
Figure 34C:
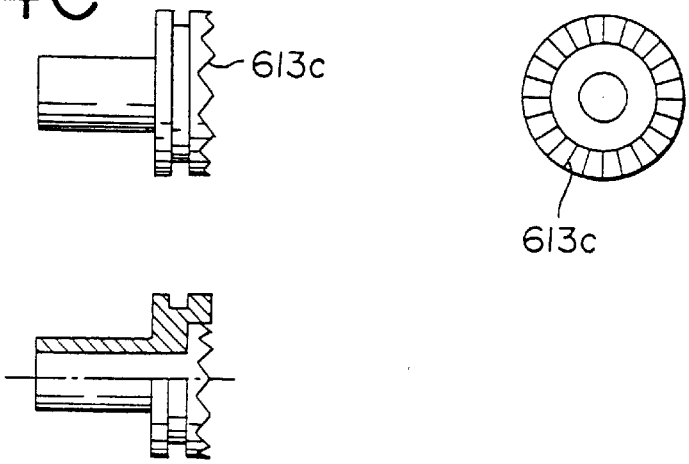

FIGS. 34A–34C are respectively a front view, a side view, and a half-sectioned view illustrating various shapes of ratchets for the ratchet units of the torque limiters.

The ratchets 606, 613 with the shapes as illustrated in FIG. 34A and FIG. 34B do not suffer the load of thrust while the reels are in rotation. The ratchet unit 601 illustrated in FIG. 34A is provided further with a guide 632 of the shape of a truncated cone. The guide 632 is so designed to lead the hollow shaft of the reel 530 and align axes of the ratchet unit 601 and the reel 530 when the reel 530 is engaged with the ratchet unit 601. Namely, the provision of the guide 632 results in facilitating the engagement of the ratchet 606 of the ratchet unit 601 and the ratchet 610 of the reel 530.

The ratchet 613c with the shape illustrated in FIG. 34C suffers the load of thrust while the reel is in rotation. The ratchet 613c with this tooth form has difficulty in coming in contact with the teeth on the reel side. And the edges of the torque limiter and the reel tend to easily engage each other. This shape of ratchet, however, disperses force and impairs the uniformity of the tension exerted on the ink film as compared with the shapes of ratchet shown in FIG. 34A and FIG. 34B. For this reason, the shape of ratchet illustrated in FIG. 34A is applied to the torque limiters 571, 572 of the fifth embodiment with consideration to the ease of alignment of the axes of the ratchet units 601, 612 and the reels 530, 531.

During the conveyance of the ink film 32, the second torque limiter 572 on the take-up side draws the ink film 32 by rotating the gear 611 as shown by an arrow mark, and the first torque limiter 571 on the supply side restrains the motion of the film 32 by setting fast the gear 600 with reference to FIG. 30A and FIG. 30B. In a word, the torque limiters 571, 572 act in opposite directions on the supply side and the take-up side. The ratchets 606, 613 and 610, 614 of the ratchet units 601, 612 and the reels 530, 531 are directed oppositely on the supply side and the take-up side. Accordingly, the ratchets 606 and 614 are not engaged and the ratchets 613 and 610 are not engaged when the reels 530, 531 are mounted oppositely, namely when the supply reel 530 is mounted on the side of the second torque limiter 572 and the take-up reel 531 is mounted on the side of the first torque limiter 571. As a result, the upper frame 573 cannot be perfectly closed to the lower frame 574 and a gap is formed between the frames 573, 574. The occurrence of this gap enables the user to perceive the fact that the reels 530, 531 have been incorrectly inserted on the supply side and the take-up side. The second torque limiter 572 is only rotated idly and the reels 530, 531 do not rotate when the ink film cassette 533 in which the reels 530, 531 have been set oppositely is mounted in the apparatus 10. The positioning of the start point of the ink film is not completed within a fixed duration. As a result, the operation of the apparatus 10 is brought to a stop because of the error. A user comes to perceive the fact that the reels have been incorrectly set in the supply side and the take-up side respectively based on a message on the display of the apparatus 10, for example. Namely, the erroneous loading of reels can be precluded.

<<Opening and Closing of Ink Film Cassette by Sliding Motion>>

Figure 35A:
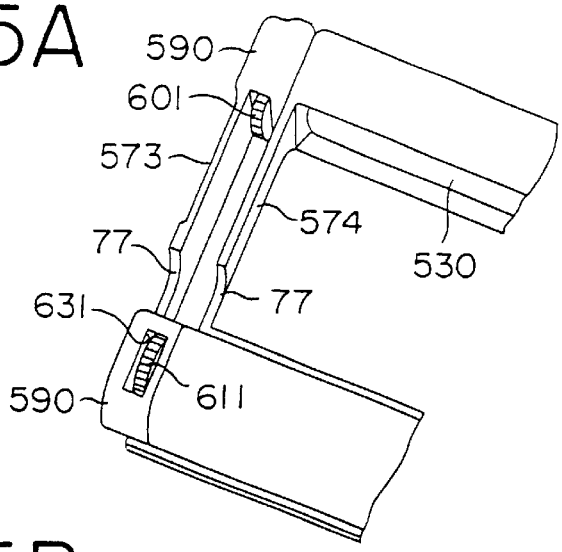
FIGS. 35A–35C are diagrams illustrating the state in which the ink film cassette is opened and closed by sliding motion, with the cassette turned upside down.
Figure 35B:
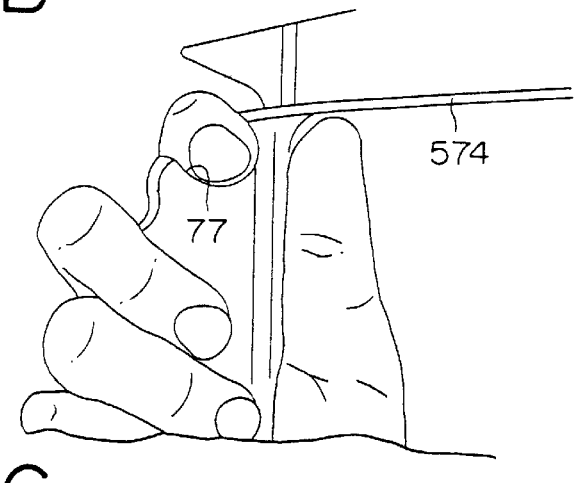
Figure 35C:
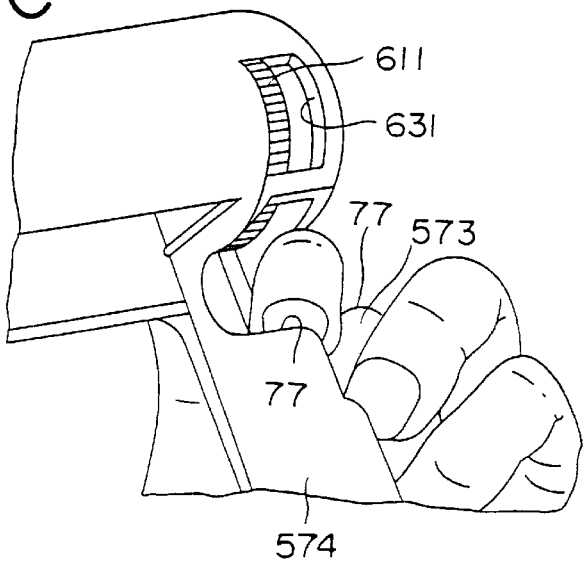

FIGS. 35A–35C are diagrams illustrating the state in which the ink film cassette is opened and closed by sliding motion, with the cassette turned upside down.

In opening or closing the ink film cassette 533 by sliding motion, the user holds the lower frame 574 by one hand and the upper frame 573 by the other hand.

The portion of the lower frame 574 that the user holds by hand is defined as the lateral wall, which is enclosed with an alternate long and short dash line in FIG. 23. A wall thickness of this potion is relative large in order for the user to take easy hold of the frame. A stainless steel plate may be stuck on the portion when necessary for the purpose of adjusting the balance between the lower frame 574 and the reels 530, 531. A rib 633 shown by an imaginary line in FIG. 23 may be provided on the lower frame 574, when necessary. In the case, the rib 633 functions as a support for supporting the lower frame 574 with a thumb while the ink film cassette 533 is opened or closed by sliding motion.

The portion of the upper frame 573 that holds the upper frame 573 is defined as an upper surface, which is enclosed with an alternate long and short dash line in FIG. 24. The reels 530, 531 of relatively large weight are absent and the torque limiters 571, 572 of relatively small weight only are present in the upper frame 573. Thus, the upper frame 573 poses no problem about the balance of weight. The upper frame 573 has an upper surface of a relatively large width. It does not particularly need the provision of the portion, which is used for supporting the upper frame 573 with a thumb while the ink film cassette is opened or closed by sliding motion.

FIG. 35A illustrates the neighborhood of the cover 590 as viewed from the reverse side. It is noted from this diagram that an empty space, which is enough to admit a finger, is opened. FIG. 35B illustrates the state in which the lower frame 574 is held with a hand. It is noted from this diagram that an index finger enters a notch 77 of the lower frame 574 to ensure ease of handling. FIG. 35C illustrates the state in which the upper frame 573 is held with a hand. It is noted from this diagram that an index finger enters the notch 77 of the upper frame 573 to ensure ease of handling.

<<Advantage of Fifth Embodiment>>

Figure 36:
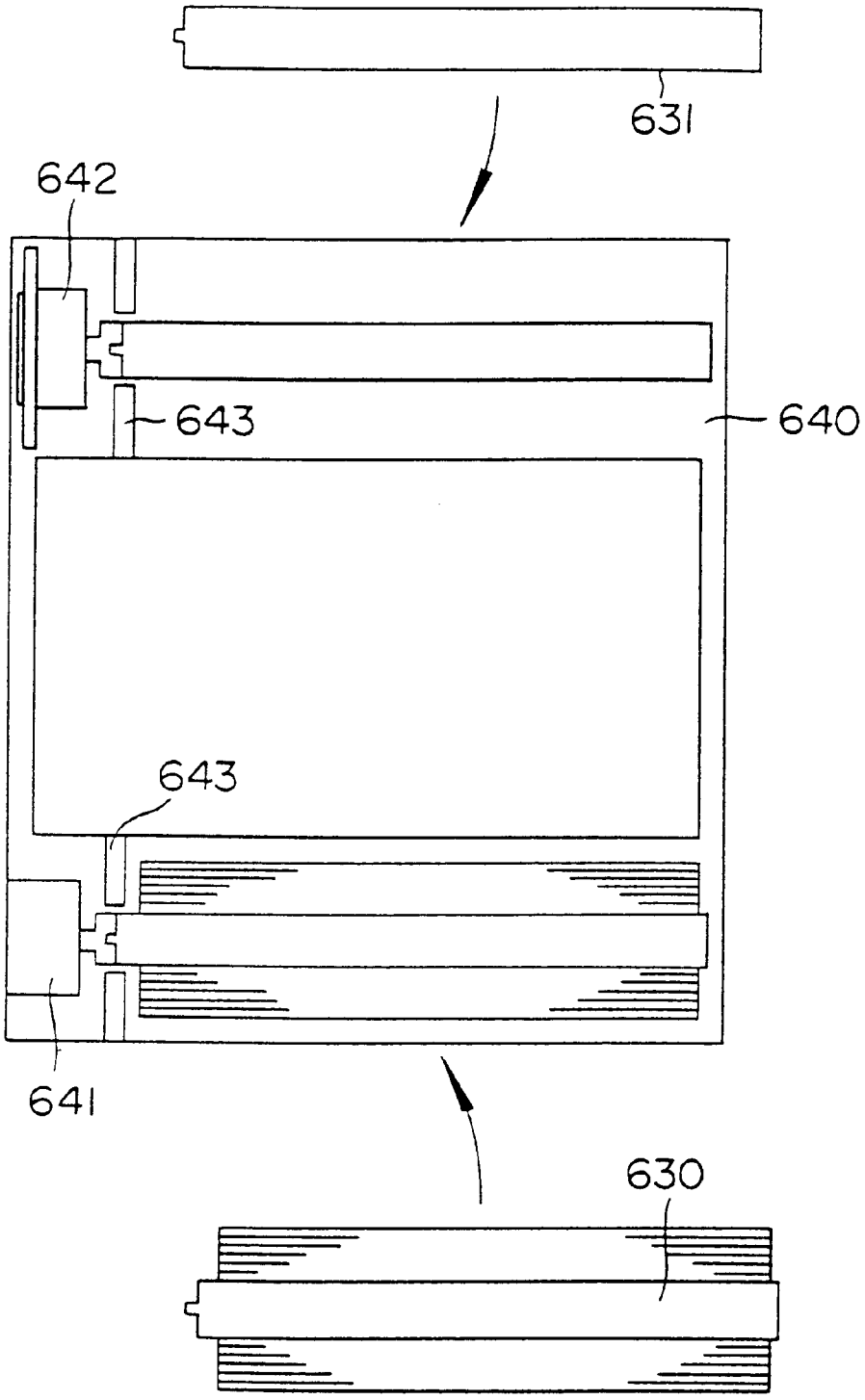
FIG. 36 is a diagram illustrating the advantages derived from holding the torque limiters on the upper frame and the reels on the lower frame, as annexed by a plan view showing an ink film cassette of a comparative case, in which the lower frame for supporting the reels is provided with the torque limiters.

The following advantage is derived from holding the torque limiters 571, 572 on the upper frame 573 and the reels 530, 531 on the lower frame 574 to hold, according to the fifth embodiment. FIG. 36 is a diagram illustrating the advantage, specifically a plan view showing an ink film cassette according to a comparative case, in which the lower frame for holding the reels is provided with the torque limiters.

The edges of the reels must be aligned with the edges of the torque limiters 641, 642 at the same time that the reels 630, 631 are set in place when a lower frame 640 is provided with torque limiters 641, 642 as in the comparative case illustrated in FIG. 36. Incidentally, the ink film 32 is suspended as passed around the opposed reels like a frame of eyeglass (hereinafter referred to as "eyeglass winding"). In consequence, it is a highly complicated task on the part of the user to mount the two reels 630, 631, which are interconnected through of the film 32, in operating position and at the same time align the reels 630, 631 with the torque limiters 641, 642.

A hole diameter of a holding component 643 must be large in order that the edges of the reels are brought obliquely from above into engagement with the edges of the torque limiters 641, 642. It jeopardizes the high quality of an image. However, the edges of the reels cannot be brought obliquely from above into engagement with the edges of the torque limiters 641, 642 when the hole diameter of the holding component 643 is small. Thus, the reels 630, 631 must be moved by sliding motion toward the torque limiters 641, 642. The space, which is indispensable to this motion by sliding, results in enlarging the ink film cassette.

In the fifth embodiment, the lower frame 574 and the upper frame 573 are so designed as to holds the reels 530, 531 and the torque limiters 571, 572 respectively, for mounting with a sliding motion. It allows easy attachment and detachment of the reels 530, 531 and prevents the cassette 533 with the built-in torque limiters 571, 572 from unduly growing in dimension. It is further made possible to avoid sacrificing the dimensional accuracy with which the reels 530, 531 are held in position.

<<Advantages in Terms of Shape of Connected Surfaces of Reels and Torque Limiters, etc.>>

Figure 37A:
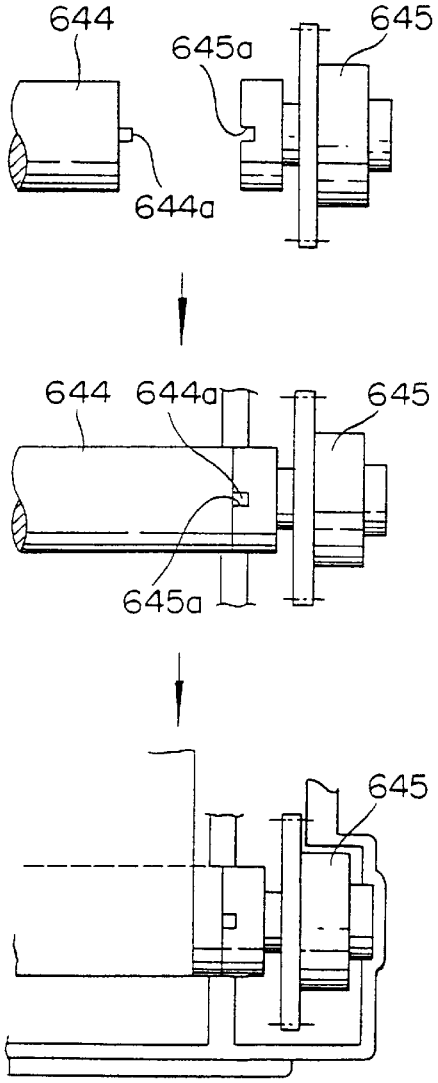
FIG. 37A and FIG. 37B are illustrating the shapes of connected surfaces when the edges of the reel and the torque limiter are engaged and connected.
Figure 37B:
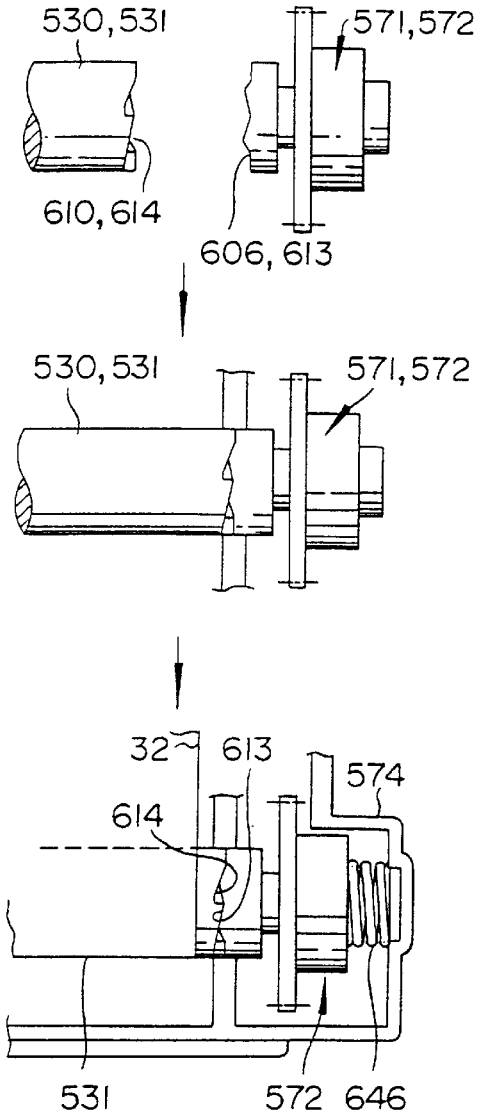

FIG. 37A and FIG. 37B are diagrams illustrating the shapes of connected surfaces when the edges of the reel and the torque limiter are engaged and connected.

In a comparative case as illustrated in FIG. 37A, a protrusion 644*a* is formed on the edge of a reel 644 and a recess 645*a* conforming to the protrusion 644*a* is formed on the edge of a torque limiter 645. It requires rotating the torque limiter 645 until the recess 645*a* confronts the protrusion 644*a* when the reel 644 is mounted in operating position.

In a case as illustrated in FIG. 37B, the connected surfaces of the reels 530, 531 and the torque limiters 571, 572 are each formed in the shape of a ratchet. The inclined faces (saw tooth form) of the ratchets function as producing relative rotation between the reels 530, 531 and the torque limiters 571, 572 even though the connected surfaces of the reels 530, 531 and the torque limiters 571, 571 are not normally connected. It causes the reels and the torque limiters to be perfectly engaged and the connected surfaces to be set being in a normal state of union. Namely, the reels 530, 531 do not need to be aligned while being mounted in operating position. Accordingly, the attachment of the reels 530, 531 and the replacement of a spent ink film with a newly supplied ink film are performed easily and the reels 530, 531 and the torque limiters 571, 572 are connected with simplicity. It is, therefore, understood that the engagement of the reels 530, 531 and the torque limiters 571, 572 is easily attained when the connected surfaces are formed of ratchets 606, 610, 613 and 614 as contemplated by the fifth embodiment, therefore.

As illustrated in FIG. 37B, it is also permissible to interpose a compression spring 646 as an urging member between the lower frame 574 and the torque limiters 571, 571 and causes the connected surfaces of the reels 530, 531 and the connected surfaces of the torque limiters 571, 572 to be mutually pressed with the resilient force of the spring 646. In this case, the reels 530, 531 and the torque limiters 571, 571 are relatively rotated under the influence of the resilient force of the spring 646. As a result, the lock condition that has the opposed rows of teeth kept in mere contact and not in normal engagement, is avoided. And the reels and the torque limiters can be infallibly and smoothly engaged. Further, the resilient force of the spring 646 can prevent the state of engagement between the reels 530, 531 and the torque limiters 571, 572 from producing any play. The urging member may be disposed on the side of the reels 530, 531. Because the urging member has only to exert the resilient force in the direction of pressing the connected surfaces of the reels 530, 531 and the connected surfaces of the torque limiters 571, 572 against each other.

Figure 38A:
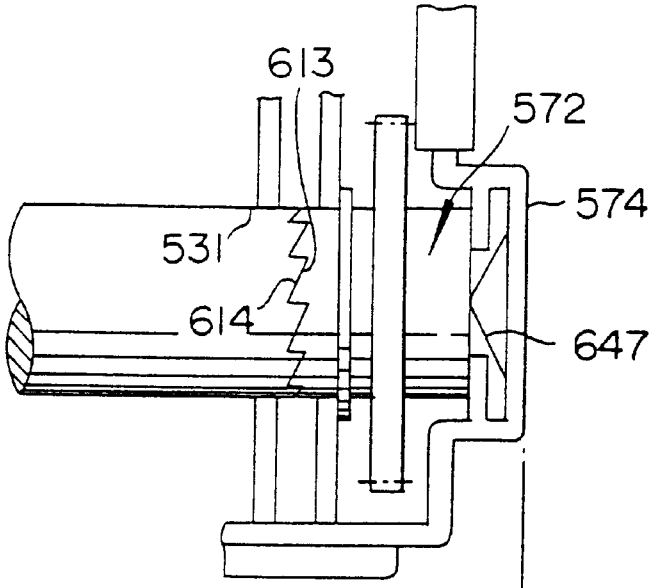
FIG. 38A is a cross section illustrating the state in which a plate spring is used for pressing the torque limiter and FIG. 38B are cross section illustrating the state in which the frame is formed in smaller visible sizes by omitting the plate spring.

FIG. 38A is a diagram illustrating a modification of the urging member. As illustrated in the diagram, a plate spring 647 may be used as the urging member in the place of the compression spring 646. The choice of the plate spring 647 as the urging member allows a reduction in the visible dimensions of the frames 573, 574.

Figure 38B:
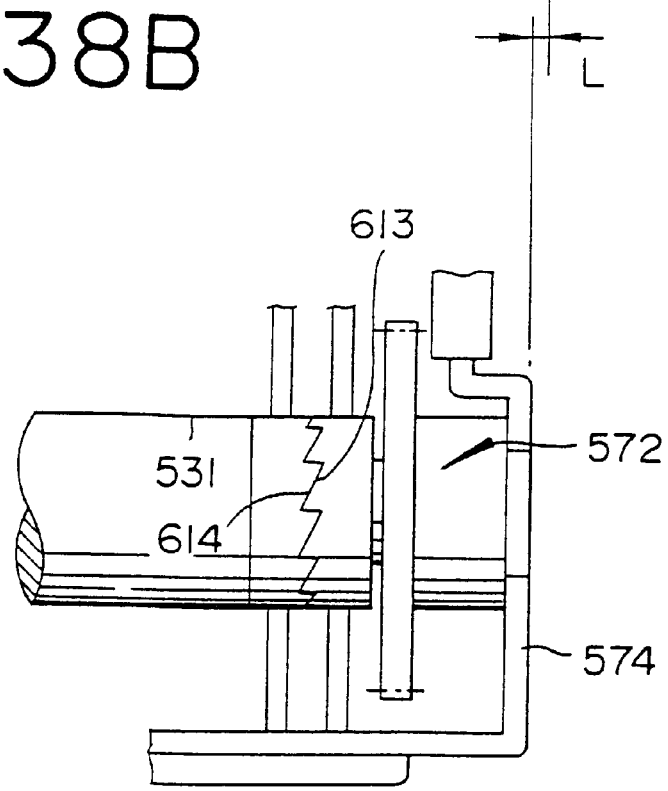

It is further allowable to preclude the provision of the plate spring 646 by conferring a certain degree of flexibility on the frames 573, 574 of the cassette as illustrated in FIG. 38B. In this case, the lower frame 574 with the flexibility constitutes itself an urging member. The elimination of the plate spring 647 results in a further decrease of about 4mm in the visible dimensions of the frames 573, 574.

The ink film cassette 533 of the fifth embodiment has the built-in torque limiters. It accomplishes simplification of the thermal transfer recording apparatus and reduction in cost and size, i.e. the advantages proper for the type. It results in essentially removing the possibility of missing the torque limiters 571, 572 or confusing and misplacing the torque limiters 571, 572 on the side of the supply side or the take-up in operating position in case of the replacement of the ink film. And, it realizes the recycling and the recovery of the torque limiters 571, 572 and decreases the number of wasted components to the fullest possible extent and contributes to the conservation of the environment.

Further, the lower frame 574 holds the reels 530 and 531 and the upper frame 573 holds the torque limiters 571 and 572, separately. Accordingly, the attachment and detachment of the reels 530, 531 to the upper frame 573 can be attained without requiring to pay due respect to the torque limiters 571, 572 and can be fulfilled with ease. Moreover, it does not require the space, which is used for the work of interlocking the reels 530, 531 with the torque limiters 571, 572 and prevents the possible increase of the size of the cassette.

The ink film cassette 533 is simply assembled by mounting the reels 530, 531 on the lower frame 57, and sliding the upper frame 573 as a lid. At this time, the upper frame 573 holds the torque limiters 571, 572. Thus, a user does not need to be conscious of engaging the edges of the torque limiters 571, 572 with the edges of the reels 530, 531 in case of the replacement of the ink film. In a word, a user more easily replaces a spent ink film with a new supply.

The connected surfaces of the reels 530, 531 and the torque limiters 571, 572 are each formed in the shape of a ratchet. The inclined faces (saw tooth form) of the ratchets function as perfectly engaging the reels 530, 531 with the torque limiters 571, 572. It does not require aligning the reels 530, 531 in case of the mounting. Thus, the attachment of the reels 530, 531 and the replacement of a spent ink film with a newly supplied ink film are performed easily. And, the reels 530, 531 and the torque limiters 571, 572 are connected with simplicity.

The ink film 32 is wound in the form of eyeglass winding and the ratchets are directed oppositely on the supply side and the take-up side. Accordingly, the gear 611 of the second torque limiter 572 is rotated idly and the reels 530, 531 are not rotated when the reels 530, 531 are misplaced to the lower frame 574 with confusion in the choice between the take-up side and the supply side. It can prevent the misplacement of the reels 530, 531 and eliminate the possibility of the ink being wasted by the misplacement.

Incidentally, the mounting of the reels 530, 531 to the lower frame 574 can be done easily when the urging members 646, 647 are utilized for pressing the connected surfaces of the reels 530, 531 and the connected surfaces of the torque limiters 571, 572 against each other. The reels 530, 531 and the torque limiters 571, 572 can also be rotated relatively and infallibly engaged with each other. It prevents the union between the reels 530, 531 and the torque limiters 571, 572 from producing any play.

Further, the first torque limiter 571 exerts a braking force on the supply reel 530 inside the ink film cassette 533. The ink film 32 is not readily paid out of the supply reel 530 under the influence of an external force and the unused ink film 32 is not wasted when this ink film cassette 533 is shipped as a consumable product. Likewise, the ink film 32 is not readily paid out of the supply reel 530 under the influence of an external force and the unused ink film 32 is not wasted when the ink film cassette 533 is detached from the thermal transfer recording apparatus 10 while the ink film 32 is still in the process of use.

The entire disclosure of japanese Patent Applications No. 08-290735, No. 08-290736, No. 08-290737, and No. 08-290738 filed on Oct. 31, 1996, including the specification, claims, drawings and summary is incorporated herein by reference in its entirety.

What is claimed is:

1. An ink film cassette for being detachably mounted to a thermal transfer recording apparatus, the cassette comprising:

a first frame;

a second frame detachably mounted to said first frame;

a supply reel which is wound with an ink film;

a take-up reel for taking up ink film paid out of said supply reel, said supply reel and said take-up reel each being rotatably mounted in said first frame; and a braking unit for providing a braking force to said supply reel in said cassette, said braking unit being fixed to said second frame and being positioned so as to operatively engage an end edge of said supply reel when said first frame and said second frame are attached.

2. An ink film cassette according to claim 1, wherein said first frame and said second frame include holding members for engagement therebetween for maintaining said first frame and said second frame in an attached state, said holding members being configured to be engaged and disengaged by relative sliding motion between said first frame and second frame along a direction along axes of said supply reel and said take-up reel.

3. An ink film cassette according to claim 1, wherein said braking unit is formed by connecting a torque limited through ratchet gears to edge faces of said supply reel in a direction of an axis of said supply reel.

4. An ink film cassette according to claim 1, further comprising a torque limiting unit which is fixed to said second frame for limiting a quantity of drive torque applied to said take-up reel in said cassette.

5. An ink film cassette according to claim 4, wherein said first frame and said second frame include holding members for engagement therebetween for maintaining said first frame and said second frame in an attached state, said holding members being configured to be engaged and disengaged by relative sliding motion between said first frame and said second frame along a direction along axes of said supply reel and said take-up reel.

6. An ink film cassette for being detachably mounted to a thermal transfer recording apparatus, the cassette comprising:

a first frame;

a second frame detachably mounted to said first frame;

a supply reel which is wound with an ink film;

a take-up reel for taking up ink film paid out of said supply reel, said supply reel and said take-up reel each being rotatably mounted in said first frame;

a braking unit for providing a braking force to said supply reel in said cassette, said braking unit being fixed to said second frame and being positioned so as to operatively engage said supply reel when said first frame and said second frame are attached, said braking unit acting on an edge of said supply reel; and a mark member corresponding to a type of the ink film;

wherein said braking unit is positioned so as to act on one edge of said supply reel, and said mark member is positioned at another edge of said supply reel.

7. An ink film cassette according to claim 6, wherein the mark member comprises an extension on one of said reels.

8. An ink film cassette according to claim 6, wherein said mark member is a flange.

9. An ink film cassette according to claim 6, wherein the mark member is a reflecting sheet.

10. An ink film cassette according to claim 6, wherein said mark member is fixed to said supply reel so as to be rotatable therewith, said mark member being adapted for detection by a detector in said recording apparatus.

11. An ink film cassette for being detachably mounted to a thermal transfer recording apparatus, the cassette comprising:

an upper frame;

a lower frame detachably mounted to said upper frame;

a supply reel which is wound with an ink film;

a take-up reel for taking up ink film paid out of said supply reel, said supply reel and said take-up reel each being rotatably mounted in said lower frame;

a first torque limiter for providing a braking force to said supply reel inside said cassette, said first torque limiter being fixed to said upper frame and being positioned so as to operatively engage said supply reel when said upper frame and said lower frame are attached; and a second torque limiter for limiting a drive torque applied to said take-up reel inside said cassette, said second torque limiter being fixed to said upper frame and being positioned so as to operatively engage said take-up reel when said upper frame and said lower frame are attached;

wherein said torque limiters are fixed to said upper frame independently of the lower frame, and wherein said upper frame and said lower frame include holding members for engagement therebetween for maintaining said upper frame and said lower frame in an attached state, said holding members being configured to be engaged and disengaged by relative sliding motion between said upper frame and said lower frame along a direction along axial lines of said reels.

12. An ink film reel for use in an ink film cassette with a built-in torque limiter, the reel comprising:

a ratchet surface which is provided in an edge of said reel for operative engagement with said torque limiter.

13. An ink film reel according to claim 12, wherein said ratchet surface is provided in said edge of said reel and a ratchet surface is not provided in an edge opposite to said edge.

14. An ink film cassette for detachable mounting to a recording apparatus, the cassette comprising:

a first frame;

a second frame detachably mounted to said first frame;

a pair of reels rotatably mounted in said first frame; and a torque limiter fixed to said second frame;

wherein said torque limiter is supported by said second frame independently from said first frame and said torque limiter is positioned so as to operatively engage one of said reels when said first frame and said second frame are attached;

wherein said one of said reels and torque limiter have corresponding surfaces which operatively engage, said corresponding surfaces having a ratchet configuration.

15. An ink film cassette according to claim 14, further comprising an urging unit which exerts a resilient force in a direction of pressing of said corresponding surfaces of said one of said reels and said torque limiter against each other.

16. An ink film cassette according to claim 14, further comprising a second torque limiter fixed to said second frame; and wherein said reels include a supply reel, which is wound with an ink film, and a take-up reel, which takes up the ink film paid out of said supply reel, and wherein one of said torque limiters is connected to said supply reel and another of said torque limiters is connected to said take-up reel, each of said reels including ratchet surfaces for engagement with ratchet surfaces of the corresponding torque limiter, a direction of ratchets on the ratchet surface of the supply reel being opposite to a direction of ratchets on the ratchet surface of the take-up reel.

17. An ink film cassette according to claim 14, wherein said reels are detachably mounted in said first frame, and said torque limiters are mounted to said second frame so as to be held by said second frame even when said reels are removed.

18. An ink film cassette according to claim 14, wherein said torque limiters are adapted to provide a braking force to a shaft of the reel corresponding thereto.

19. An ink film cassette for detachable mounting to a recording apparatus, said cassette comprising:

a housing including first and second separable frame members;

a supply reel rotatably mounted in said first frame member;

a take-up reel rotatably mounted in said first frame member;

a braking unit for applying a braking force to said supply reel, said braking unit being fixed to said second frame member and positioned to engage said supply reel when said first and second frame members are engaged; and a torque limiting device for limiting an amount of torque transmitted via the torque limiting device to said take-up reel, said torque limiting device being fixed to said second frame member and positioned so as to engage an end edge of said take-up reel when said first and second frame members are assembled.

* * * * *

UNITED STATES PATENT AND TRADEMARK OFFICE

CERTIFICATE OF CORRECTION

PATENT NO. : 6,457,885 B1 
DATED : October 1, 2002
INVENTOR(S) : Junichi Yamamoto et al.

It is certified that error appears in the above-identified patent and that said Letters Patent is hereby corrected as shown below:

Title page,
Item [57], ABSTRACT,
Line 15, delete “through of”, and insert -- via --.

Column 3,
Line 18, after “apparatus”, delete “,”.
Line 22, after “apparatus”, delete “,”.
Line 40, after “cassette”, delete “,”.
Line 42, after “limiters”, insert -- , --.
Line 49, after “element”, delete “:”.
Line 63, delete “a”, and insert -- an --.
Line 64, delete “maybe”, and insert -- may be --.

Column 4,
Line 5, after “element”, delete “:”.
Line 24, after “reel”, delete “.”

Column 5,
Line 52, after “ratchet”, delete “,”.

Column 6,
Line 50, after “embodiment”, delete “ ” ”, and insert -- . --.

Column 7,
Line 3, after "side", delete "," and insert -- ; --.
Line 3, after "25B", insert -- is --.
Line 5, after "side", delete "," and insert -- ; --.
Line 13, delete "depicting", and insert -- depicts --.
Line 14, delete "depicting", and insert -- depicts --.
Line 21, delete the first instance of "a", and insert -- an --.
Line 22, delete the first instance of "a", and insert -- an --.
Line 29, after "frame", delete ".", and insert -- ; --.
Line 37, after "view", delete ".", and insert -- ; --.
Line 47, delete "are illustrating", and insert -- illustrate --.
Line 52, after "limiter", insert -- ; --.
Line 53, delete "are", and insert -- is a --.

UNITED STATES PATENT AND TRADEMARK OFFICE

CERTIFICATE OF CORRECTION

PATENT NO. : 6,457,885 B1
DATED : October 1, 2002
INVENTOR(S) : Junichi Yamamoto et al.

It is certified that error appears in the above-identified patent and that said Letters Patent is hereby corrected as shown below:

Column 8,
Line 13, after "film", delete "," .
Line 36, delete "a", and insert -- an --.
Line 52, after "state", delete ",", and insert -- . --.
Line 55, after "thereto", delete ",", and insert -- ; --.
Line 67, delete "a", and insert -- an --.

Column 9,
Line 4, after "stiffness", insert -- . --.
Line 6, after "transfer", delete ".".

Column 14,
Line 8, delete "an".
Line 42, after "126.", a new paragraph should be started with "Since".
Line 55, delete "t o", and insert -- to --.

Column 15,
Line 36, after "film", delete ".".

Column 16,
Line 48, delete "an", and insert -- a --.

Column 19,
Line 41, after "embodiment", delete ",", and insert -- . --.
Line 41, after "embodiment.", a new paragraph should be started with "Concerning".

Column 20,
Line 2, delete “ref lecting”, and insert -- reflecting --.
Line 17, delete “i n”, and insert -- in --.

Column 23,
Lines 63 and 64, delete “depicting”, and insert -- depicts --.

Column 24,
Line 38, delete “571,”, and insert -- 572, --.
Line 55, delete “coincidingwith”, and insert -- coinciding with --.

Column 25,
Line 12, delete the first instance of “a”, and insert -- an --.

UNITED STATES PATENT AND TRADEMARK OFFICE

CERTIFICATE OF CORRECTION

PATENT NO. : 6,457,885 B1
DATED : October 1, 2002
INVENTOR(S) : Junichi Yamamoto et al.

It is certified that error appears in the above-identified patent and that said Letters Patent is hereby corrected as shown below:

Column 26,
Line 53, delete “maybe”, and insert -- may be --.

Column 29,
Line 14, delete “through of” and insert -- via --.

Column 31,
Line 35, delete “japanese”, and insert -- Japanese --.
Line 65, delete “limited”, and insert -- limiter --.

Column 33,
Line 27, delete “wherein said one of said reels and torque limiter”, and insert -- wherein said torque limiter and one of said reels --.

Column 34,
Line 16, delete “limiters are”, and insert -- limiter is --.

Signed and Sealed this

Twenty-third Day of March, 2004

JON W. DUDAS
*Acting Director of the United States Patent and Trademark Office*